US007424254B2

(12) United States Patent
Akizuki et al.

(10) Patent No.: US 7,424,254 B2
(45) Date of Patent: Sep. 9, 2008

(54) IMAGE FORMING APPARATUS

(75) Inventors: Tomoo Akizuki, Shizuoka-ken (JP); Takateru Okubo, Susono (JP); Takuro Mita, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 252 days.

(21) Appl. No.: 11/494,564

(22) Filed: Jul. 28, 2006

(65) Prior Publication Data

US 2007/0025778 A1 Feb. 1, 2007

(30) Foreign Application Priority Data

Aug. 1, 2005 (JP) ..... 2005-222598
Jul. 24, 2006 (JP) ..... 2006-200872

(51) Int. Cl.
*G03G 15/01* (2006.01)

(52) U.S. Cl. ..... 399/299; 399/167

(58) Field of Classification Search ..... 399/167, 399/297, 298, 299, 301, 302, 303, 306, 308
See application file for complete search history.

(56) References Cited

U.S. PATENT DOCUMENTS 7,013,102 B2 * 3/2006 Ehara ..... 399/167
7,164,877 B2 * 1/2007 Murakami et al. ..... 399/121
7,239,829 B2 * 7/2007 Tanaka ..... 399/167

FOREIGN PATENT DOCUMENTS

| | | | |
|---|---|---|---|
| JP | 5-341617 | A | 12/1993 |
| JP | 7-120998 | A | 5/1995 |
| JP | 8-194351 | A | 7/1996 |
| JP | 11-15227 | A | 1/1999 |

* cited by examiner

*Primary Examiner*—Hoan H Tran
(74) *Attorney, Agent, or Firm*—Fitzpatrick, Cella, Harper & Scinto

(57) ABSTRACT

The image forming apparatus having: a rotatable first image bearing member of bearing images; a rotatable second image bearing member of bearing images; and a transferring device for transferring images respectively born by the first image bearing member and the second image bearing member onto a recording material; wherein a first mode with the first image bearing member and the second image bearing member coming in contact with the transferring device so that images are formed respectively onto the first image bearing member and the second image bearing member and a second mode with the first image bearing member and the transferring device being set apart and the second image bearing member coming in contact with the transferring device so that an image is formed onto the second image bearing member are executable; and wherein, at the second mode, the first image bearing member starts rotation from a rotation stopped state and thereafter rotation stops. Thereby an image bearing member can be restrained from contacting recording material or transferring device to get deteriorated.

21 Claims, 13 Drawing Sheets

| ATMOSPHERE | SHEET TYPE | DRIVE INTERVAL |
|---|---|---|
| L/L | THIN SHEET | 40 |
| | NORMAL SHEET | 80 |
| | THICK SHEET | 80 |
| | ROUGH SHEET | 40 |
| N/N | THIN SHEET | 20 |
| | NORMAL SHEET | 40 |
| | THICK SHEET | 40 |
| | ROUGH SHEET | 20 |
| H/H | THIN SHEET | 10 |
| | NORMAL SHEET | 20 |
| | THICK SHEET | 20 |
| | ROUGH SHEET | 10 |

FIG. 8

| | ATMOSPHERE | SHEET TYPE | 20 SHEETS | 50 SHEETS | 100 SHEETS | 200 SHEETS | 500 SHEETS | 1000 SHEETS | 2000 SHEETS | 5000 SHEETS |
|---|---|---|---|---|---|---|---|---|---|---|
| EMBODIMENT 1 | L/L | THIN SHEET | ○ | ○ | ○ | ○ | ○ | ○ | ○ | ○ |
| | | NORMAL SHEET | ○ | ○ | ○ | ○ | ○ | ○ | ○ | ○ |
| | | THICK SHEET | ○ | ○ | ○ | ○ | ○ | ○ | ○ | ○ |
| | | ROUGH SHEET | ○ | ○ | ○ | ○ | ○ | ○ | ○ | ○ |
| | N/N | THIN SHEET | ○ | ○ | ○ | ○ | ○ | ○ | ○ | ○ |
| | | NORMAL SHEET | ○ | ○ | ○ | ○ | ○ | ○ | ○ | ○ |
| | | THICK SHEET | ○ | ○ | ○ | ○ | ○ | ○ | ○ | ○ |
| | | ROUGH SHEET | ○ | ○ | ○ | ○ | ○ | ○ | ○ | ○ |
| | H/H | THIN SHEET | ○ | ○ | ○ | ○ | ○ | ○ | ○ | ○ |
| | | NORMAL SHEET | ○ | ○ | ○ | ○ | ○ | ○ | ○ | ○ |
| | | THICK SHEET | ○ | ○ | ○ | ○ | ○ | ○ | ○ | ○ |
| | | ROUGH SHEET | ○ | ○ | ○ | ○ | ○ | ○ | ○ | ○ |

FIG. 9

| | ATMOSPHERE | SHEET TYPE | 20 SHEETS | 50 SHEETS | 100 SHEETS | 200 SHEETS | 500 SHEETS | 1000 SHEETS | 2000 SHEETS | 5000 SHEETS |
|---|---|---|---|---|---|---|---|---|---|---|
| COMPARISON EXAMPLE | L/L | THIN SHEET | ○ | ○ | ○ | ○ | ○ | ○△ | ○△ | ○△ |
| | | NORMAL SHEET | ○ | ○ | ○ | ○ | ○ | ○ | ○△ | ○△ |
| | | THICK SHEET | ○ | ○ | ○ | ○ | ○ | ○ | ○△ | ○△ |
| | | ROUGH SHEET | ○ | ○ | ○ | ○ | ○△ | ○△ | △ | △ |
| | N/N | THIN SHEET | ○ | ○ | ○△ | ○△ | △ | △ | △ | △× |
| | | NORMAL SHEET | ○ | ○ | ○ | ○△ | ○△ | ○△ | △ | △ |
| | | THICK SHEET | ○ | ○ | ○△ | ○△ | ○△ | ○△ | △ | △ |
| | | ROUGH SHEET | ○ | ○ | ○△ | ○△ | △ | △ | △ | △× |
| | H/H | THIN SHEET | ○ | ○△ | △ | △× | × | × | × | × |
| | | NORMAL SHEET | ○ | ○ | ○△ | ○△ | ○△ | △ | △ | △× |
| | | THICK SHEET | ○ | ○ | ○△ | ○△ | △ | △ | △ | △× |
| | | ROUGH SHEET | ○ | ○△ | △ | △× | × | × | × | × |

FIG. 10

| | ATMOSPHERE | SHEET TYPE | 20 SHEETS | 50 SHEETS | 100 SHEETS | 200 SHEETS | 500 SHEETS | 1000 SHEETS | 2000 SHEETS | 5000 SHEETS |
|---|---|---|---|---|---|---|---|---|---|---|
| EMBODIMENT 2 | L/L | THIN SHEET | ○ | ○ | ○ | ○ | ○ | ○ | ○ | ○ |
| | | NORMAL SHEET | ○ | ○ | ○ | ○ | ○ | ○ | ○ | ○ |
| | | THICK SHEET | ○ | ○ | ○ | ○ | ○ | ○ | ○ | ○ |
| | | ROUGH SHEET | ○ | ○ | ○ | ○ | ○ | ○ | ○ | ○ |
| | N/N | THIN SHEET | ○ | ○ | ○ | ○ | ○ | ○ | ○ | ○△ |
| | | NORMAL SHEET | ○ | ○ | ○ | ○ | ○ | ○ | ○ | ○ |
| | | THICK SHEET | ○ | ○ | ○ | ○ | ○ | ○ | ○ | ○ |
| | | ROUGH SHEET | ○ | ○ | ○ | ○ | ○ | ○ | ○ | ○△ |
| | H/H | THIN SHEET | ○ | ○ | ○ | ○ | ○ | ○△ | ○△ | △ |
| | | NORMAL SHEET | ○ | ○ | ○ | ○ | ○ | ○ | ○△ | ○△ |
| | | THICK SHEET | ○ | ○ | ○ | ○ | ○ | ○ | ○△ | ○△ |
| | | ROUGH SHEET | ○ | ○ | ○ | ○ | ○ | ○△ | ○△ | △ |

| ATMOSPHERE | DRIVE INTERVAL |
|---|---|
| L/L | 500 |
| N/N | 120 |
| H/H | 50 |

IMAGE FORMING APPARATUS

BACKGROUND OF THE INVENTION

1. Field of the Invention

The present invention relates to an image forming apparatus such as a photocopier, a printer, a facsimile and the like of electrophotographic system and in particular to an image forming apparatus having a plurality of image bearing members.

2. Description of the Related Art

In recent years, coloring in image forming apparatuses such as printers, photocopiers and the like has been being advanced. As color image forming apparatus in an electrophotographic system, so-called tandem type color image forming apparatuses that sequentially dispose a plurality of photosensitive drums corresponding with colors respectively in a line to overlap respectively colored toner images formed on respective photosensitive drums onto a transferring medium to form color images are becoming widespread as a mainstream trend.

FIG. 15 is a schematic configuration diagram showing an example of a tandem-type full-color image forming apparatus in a prior art electrophotographic system.

Such an image forming apparatus comprises four image forming parts (image forming units) of an image forming part 101M that forms magenta-color images, an image forming part 101C that forms cyan-color images, an image forming part 101Y that forms yellow-color images, an image forming part 101B*k* that forms black-color images and those four image forming parts are disposed in a line in a constant interval.

Respective image forming parts 101M, 101C, 101Y and 101B*k* are provided with photosensitive drums 102*a*, 102*b*, 102*c* and 102*d* respectively. Surrounding charging rollers 103*a*, 103*b*, 103*c* and 103*d*, developing apparatuses 104*a*, 104*b*, 104*c* and 104*d*, transferring rollers 105*a*, 105*b*, 105*c* and 105*d*, cleaning apparatuses 106*a*, 106*b*, 106*c* and 106*d* are respectively provided, and above between the charging rollers 103*a*, 103*b*, 103*c* and 103*d* and the developing apparatuses 104*a*, 104*b*, 104*c* and 104*d*, exposure apparatuses 107*a*, 107*b*, 107*c* and 107*d* are respectively provided. Magenta toner, cyan toner, yellow toner and black toner are housed in the developing apparatuses 104*a*, 104*b*, 104*c* and 104*d* respectively.

A method of forming images in full-color onto recording material with the above described color image forming apparatus is carried out by toner images in respective colors respectively formed on respective photosensitive drums 102*a*, 102*b*, 102*c* and 102*d* being sequentially overlapped for transfer onto recording material P born on a recording material conveying belt 108. At that time, the recording material undergoes sheet feeding with a sheet feeding roller 113 so that with an adherence roller 111 is adhered onto the recording material conveying belt 108 electrostatically and is born and conveyed with the recording material conveying belt 108. Thereafter, the recording material P separated from the recording material conveying belt 108, on which a full-color toner image is fixed with a fixing nip part between a fixing roller 112*a* and a pressing roller 112*b* of the fixing apparatus 112, is discharged outside of the machine.

In addition, frequently used is an intermediate transfecting method that brings a toner image formed with respective image forming parts into multiple transfer onto an intermediate transferring belt temporarily and thereafter into collective transfer onto the recording material P as a full-color image forming method besides the above described multiplex transferring system.

Those color image forming apparatuses do not always implement multicolor printing, that is, full-color printing, but frequency of implementing mono-color printing is rather high. Especially in the recent years, color printers in anticipation of replacement to mono-color printers have been increasing more and more, and in such color printers, performance of mono-color printer tends to be regarded very important.

In the above described prior art color image forming apparatus, the case where four image forming parts (image forming units) 101M, 101C, 101Y and 101B*k* operate also at the time of mono-color image forming (black mono-color printing) happened to give rise to a problem that image forming parts 101M, 101C, 101Y in color toner that does not form images also were deteriorated in photosensitive drums and developer likewise at the time of the above described color printing.

In order to solve such a problem, a system of halting developing apparatuses 104*a*, 104*b* and 104*c* except black (Bk) at the time of mono-color image forming, is described in Japanese Patent Application Laid-Open No. H8-194351. According to this system, deterioration of color developer due to agitation with a developing device can be prevented.

In addition a system of providing a bypass conveyance paths dedicated for outputting mono-color image is described in Japanese Patent Application Laid-Open No. H5-341617. According to this system, mono-color images can be outputted without deteriorating color image forming parts.

Moreover, frequently used is a configuration to set a recording material conveying belt or an intermediate transferring belt spaced apart from photosensitive drums 102*a*, 102*b* and 102*c* of color toner at the time of mono-color print image forming so as not to consume image forming parts 101M, 101C and 101Y of color toner.

For example, there nominated are a configuration of spacing transferring means of a color-toner part apart at the time of implementing multiplex transfer directly onto recording material to form a mono-color image as described in Japanese Patent Application Laid-Open No. H11-15227 and a configuration of spacing intermediate transferring means of a color-toner part at the time of forming a mono-color image in a color-image forming apparatus of a tandem type in use of an intermediate transferring belt as described in Japanese Patent Application Laid-Open No. H07-120998.

There, such a system as described in Japanese Patent Application Laid-Open No. H05-341617 will end in complicating image forming apparatuses and increasing size, and therefore, the mainstream is the system with the configuration that sets a recording material conveying belt or an intermediate transferring belt spaced apart from photosensitive drums 102*a*, 102*b* and 102 *c*.

FIG. 6 shows a configuration of setting apart transferring means at the time of mono-color printing in the configuration of direct multiplex transfer onto recording material.

Moving positions of transferring rollers 105*a*, 105*b* and 105*c* and a recording material conveying belt 108, photosensitive drums 102*a*, 102*b* and 102*c* in image forming parts other than black are set apart from the recording material conveying belt 108. Since the photosensitive drum 102*d* and the recording material conveying belt 108 are in contact, mono-color images can be formed and deterioration in performance of image forming parts of color toner can be reduced only in use of the image forming part 101Bk to implement image forming.

However, in case of setting apart the transferring parts of color toner, at the time when mono-color printing is carried out, the recording material and intermediate transferring belt may slide on the photosensitive drums 102*a*, 102*b* and 102*c*, possibly giving rise to image defects at the time of full-color printing after mono-color printing.

Detailed description will come as follow.

In use of a configuration of spacing transferring means of a color-toner part apart at the time of implementing multiplex transfer directly onto recording material to form a mono-color image as described in Japanese Patent Application Laid-Open No. H11-15227, the recording material P may end in floating from the recording material conveying belt 108 and the recording material P will slide on the photosensitive drums 102*a*, 102*b* and 102*c*. Sliding for one printing will not result in any problems, but nevertheless, in case of carrying out mono-color printing continuously in a large quantity, sliding will take place at the same sites of the photosensitive drums 102*a*, 102*b* and 102*c*, and therefore image defects (scars in sliding memory and drums) will occur at the time of full-color printing after mono-color printing.

Urging adherence force onto the recording material conveying belt with electrostatic adherence means such as the adherence roller 111 and the like, chances of sliding themselves will decrease, but resistance of the recording material could go down depending on atmospheric environment and recording material for use in image forming apparatuses, but at that time, current from the adherence roller 111 might travel on the surface layer of the recording material to flow into the photosensitive drums 102*a*, 102*b* and 102*c*. At that time, potential of photosensitive drums 102*a*, 102*b* and 102*c* might be caused to change inappropriately, image defects could occur corresponding with sliding parts at the time of full-color printing after mono-color printing even with not so many cases of sliding by making it impossible to set the sliding parts of the photosensitive drums to appropriate potentials at the time of next charging.

In particular, in a configuration of arranging image forming part vertically or diagonally, the recording material P's own weight acts in such a direction to be delaminated from recording material conveyance means and therefore conveyance of the recording material is apt to get unstable.

In addition, in case of occurrence of ruffling, core set marks and bending in the intermediate transferring belt, the belt may likewise slide on the photosensitive drums so as to give rise to image defects (scars in sliding memory and drums) at the time of full-color printing after mono-color printing also in a configuration of setting intermediate transferring means at color-toner parts apart at the time of forming mono-color images in a tandem-color image forming apparatus in use of an intermediate transferring belt as described in Japanese Patent Application Laid-Open No. H07-120998.

In particular, some atmospheric environments and belts for use in image forming apparatuses could lower the resistance of the belts and consequently bias for use with transferring bias and belt cleaning means (a cleaning system taking place simultaneously with transfer, a fur brush system and the like) could flow into the photosensitive drums 102*a*, 102*b* and 102*c*. At that time, changing potentials of the photosensitive drums 102*a*, 102*b* and 102*c* inappropriately so as to disenable the sliding parts to derive appropriate potentials at the time of next charging, image defects corresponding with the sliding parts happened to occur at the time of full-color printing after mono-color printing.

In particular, in case of having taped ends of intermediate transferring belts for reinforcing intensity, ruffling is apt to occur while core sets of belts is apt to be formed in case of a state where an image forming apparatus is not used for a long period and the present phenomena are apt to take place.

Those problems tend to get better by taking large clearance between the photosensitive drums and the recording material conveying belt or the intermediate member belt when they are set apart, but due to their contact in the black parts and accompanied by miniaturization of image forming apparatuses, which has been being desired more and more in the recent years, reservation of significant clearance has become difficult.

In addition, accompanied by miniaturization, current leakage as described above is apt to occur even if the recording material and intermediate transferring belts have the same resistance value.

Here, it is not preferable from the point of view of deterioration of image forming parts due to rotation of photosensitive drums, that has been regarded as a problem at the source, to drive image forming parts such as photosensitive drums 102*a*, 102*b* and 102*c* and the like at a constant speed or a slightly lower speed, which may alleviate the above described problems better, in case of separation at the time of mono-color printing.

SUMMARY OF THE INVENTION

An object of the present invention is to provide an image forming apparatus that restrains an image bearing member from contacting recording material or transferring device to get deteriorated.

Another object of the present invention is to provide An image forming apparatus including a first image bearing member which is rotatable and bears an image, a second image bearing member which is rotatable and bears an image, and a transferring device for transferring images respectively born by the first image bearing member and the second image bearing member onto a recording material, wherein the first image bearing member and second image bearing member come in contact with the transferring device and an image is respectively formed on the first image bearing member and second image bearing member in a first mode, wherein the first image bearing member is away from the transferring device and second image bearing member comes in contact with the transferring device and an image is formed on the second image bearing member in a second mode, and wherein at the second mode, the first image bearing member starts rotating from a rotation stopped state and afterward stops rotating.

More objects of the present invention will become apparent with reference to descriptions below.

Further features of the present invention will become apparent from the following description of exemplary embodiments with reference to the attached drawings.

BRIEF DESCRIPTION OF THE DRAWINGS

FIG. 8 is a table showing experimental results of Embodiment 1 related to the embodiment of the present invention.

FIG. 9 is a table showing experimental results of Comparison example.

FIG. 10 is a table showing experimental results of Embodiment 2 related to the embodiment of the present invention.

DESCRIPTION OF THE EMBODIMENTS

Preferable embodiments of the present invention will be described in detail in an exemplifying fashion with reference to the drawings as follows. Here, sizes, qualities and shapes of components described in those embodiments as well as their relative dispositions and the like should be changed appropriately in accordance with configurations of apparatuses to which the present invention is applied and various conditions but will not be intended to limit the scope of the present invention to the following embodiments.

EMBODIMENT 1

(1) Image Forming Apparatus

Figure 1:
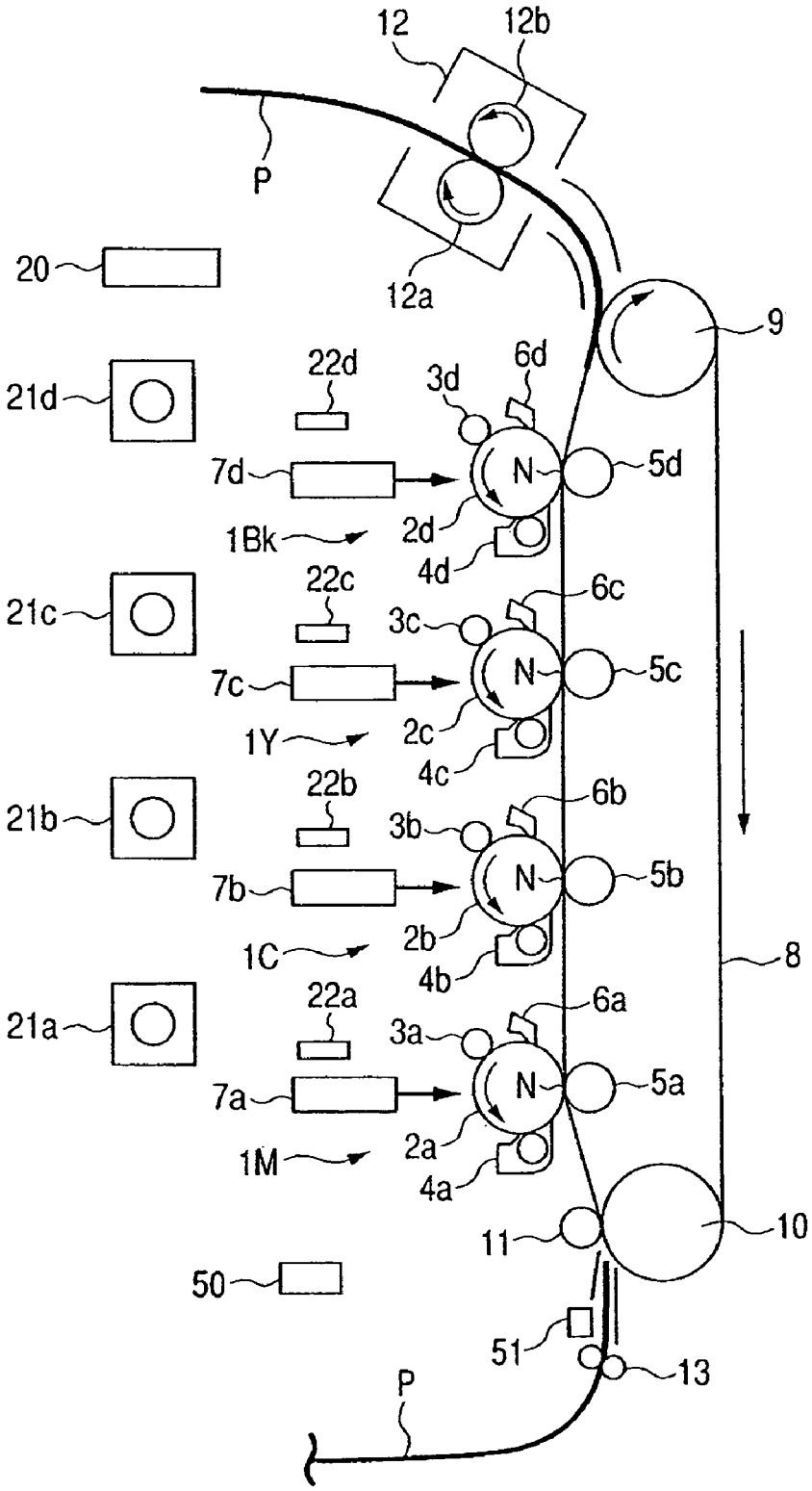
FIG. 1 is a diagram showing a color image forming apparatus being an embodiment of the present invention.

With reference to FIG. 1, an image forming apparatus related to Embodiment 1 will be described.

FIG. 1 is a schematic configuration diagram showing a color image forming apparatus (a tandem type full-color printer of an electrophotographic system color image forming apparatus in the present embodiment) related to Embodiment 1 of the present invention.

The color image forming apparatus hereof comprises four image forming parts (image forming units) of an image forming part 1M of forming magenta-color images; an image forming part 1C of forming cyan-color images; an image forming part 1Y of forming yellow-color images and an image forming part 1Bk of forming black-color images, and those four image forming parts are disposed in a line at a constant interval.

The respective image forming parts 1M, 1C, 1Y and 1Bk are provided with photosensitive drums 2*a*, 2*b*, 2*c* and 2*d* as image bearing members respectively. The photosensitive drums 2*a*, 2*b*, 2*c* and 2*d* can rotate. In the circumference of the respective photosensitive drums 2*a*, 2*b*, 2*c* and 2*d*, charging rollers 3*a*, 3*b*, 3*c* and 3*d* as charging devices, developing devices 4*a*, 4*b*, 4*c* and 4*d*, transferring rollers 5*a*, 5*b*, 5*c* and 5*d* as transferring members and drum cleaning devices (cleaning blades) 6*a*, 6*b*, 6*c* and 6*d* are respectively provided, and above between the charging rollers 3*a*, 3*b*, 3*c* and 3*d* and the developing devices 4*a*, 4*b*, 4*c* and 4*d*, exposure devices 7*a*, 7*b*, 7*c* and 7*d* are respectively provided. Magenta toner, cyan toner, yellow toner and black toner with negatively charged property respectively are housed in the respective developing devices 4*a*, 4*b*, 4*c* and 4*d*.

In the present embodiment, the photosensitive drums 2*a*, 2*b*, 2*c* and 2*d* are negatively charged organic photosensitive members and have photosensitive layers on aluminum drum base members to be rotary-driven at a predetermined process speed in directions of arrows (counterclockwise) with driving devices 21*a*, 21*b*, 21*c* and 21*d*.

Figure 2:
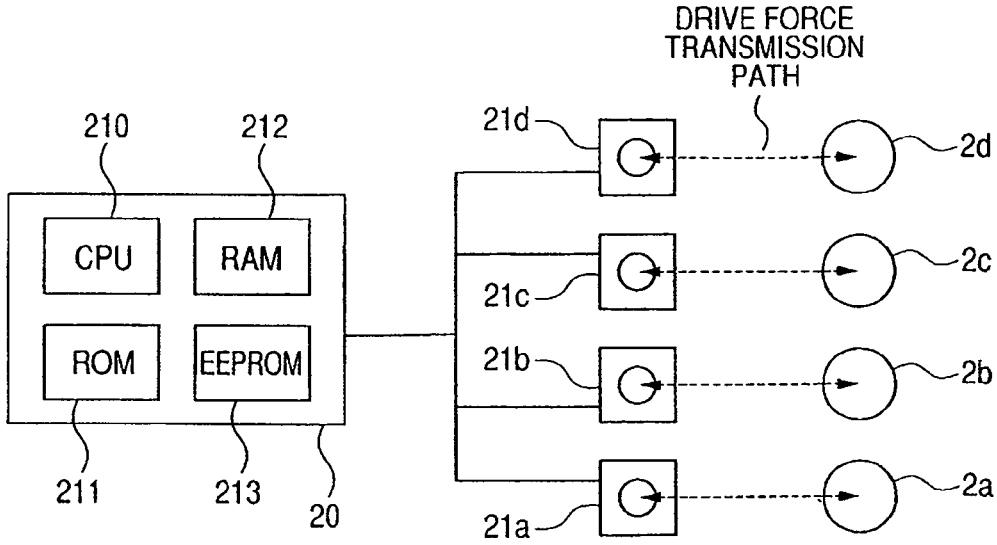
FIG. 2 is a diagram showing a mechanism of driving photosensitive drum.

A mechanism of rotary drive of the photosensitive drums 2*a*, 2*b*, 2*c* and 2*d* is diagrammatically shown in FIG. 2. The photosensitive drums 2*a*, 2*b*, 2*c* and 2*d* are driven to rotate through rotation of a train of gears for transferring driving force by rotating drum motors 21*a*, 21*b*, 21*c* and 21*d* (stepping motors are used in the present embodiment) as respective individual driving source.

Rotation of the driving sources are controlled so as to implement a desired operation by controlling motor drivers inside the drum motors 21*a*, 21*b*, 21*c* and 21*d* with a controlling portion 20.

The controlling portion 20 comprises a CPU 210 such as a microprocessor and the like; a ROM 211 keeping control programs and data of the CPU 210 in a storage; a RAM 212 used as work area at the time of executing controls by the CPU 210 and temporarily storing respective data; EEPROM 213 storing control information in a nonvolatile fashion; and the like to govern overall operations of the image forming apparatus including rotation drive of the photosensitive drums 2*a*, 2*b*, 2*c* and 2*d* and charging control of charging rollers 3*a*, 3*b*, 3*c* and 3*d*.

The charging rollers 3*a*, 3*b*, 3*c* and 3*d* contact the photosensitive drums 2*a*, 2*b*, 2*c* and 2*d* respectively with a predetermined press-contacting force.

Figure 3:
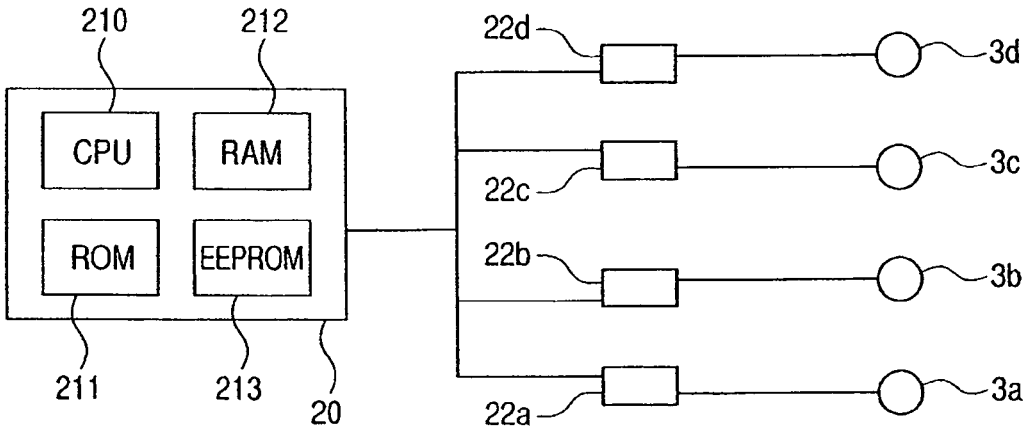
FIG. 3 is a diagram showing a mechanism of voltage application of charging rollers.

A charging mechanism of charging rollers 3*a*, 3*b*, 3*c* and 3*d* are shown diagrammatically in FIG. 3. Desired charging biases are applied to charging rollers 3*a*, 3*b*, 3*c* are 3*d* with high voltage power supply circuit (charging bias power supply (voltage applying means)) 22*a*, 22*b*, 22*c* and 22*d* by controls of the control portion 20 so as to charge the surfaces of the respective photosensitive drums 2*a*, 2*b*, 2*c* and 2*d* to reach a predetermined potential evenly. Here, the respective photosensitive drums 2*a*, 2*b*, 2*c* and 2*d* are charged to negative polarity with the respective charging rollers 3*a*, 3*b*, 3*c* and 3*d* in the present embodiment.

The present embodiment adopts contact developing system as a developing system. Developing devices 4*a*, 4*b*, 4*c* and 4*d* have developing rollers as developer bearing member and toner born in a film form on the developing rollers is conveyed to the opposite portion (developing portion) to the photosensitive drums 2*a*, 2*b*, 2*c* and 2*d* by developing rollers that rotate by a mechanism of driving development. Electrostatic latent images formed on the photosensitive drums are developed (reversely developed) as toner images with developing bias to be applied to developing rollers with developing voltage applying device.

Here, the developing rollers in the developing parts and the photosensitive drums are in a state of being in contact in a full-color image forming mode, and the developing rollers other than the developing parts of forming images and the photosensitive drums are configured to be set apart in a mono-color image forming mode to be described below. The object thereof is to prevent deterioration and consumption of the developing rollers and toner.

Transferring rollers 5*a*, 5*b*, 5*c* and 5*d* are configured with an elastic member such as sponge rubber and the like for example, contact respective photosensitive drums 2*a*, 2*b*, 2*c* and 2*d* via endless recording material conveying belt 8 being a transferring device with respective transferring nip parts N respectively and are driven by the recording material conveying belt 8 to rotate. The transferring power supply is designed to connect to the transferring rollers 5*a*, 5*b*, 5*c* and 5*d* so that transferring biases are applied to the transferring rollers.

Here, the recording material conveying belt in the transferring nip parts and the photosensitive drums are in a state in contact in all the transferring nip parts in a full-color image forming mode, and the recording material conveying belt other than in the transferring nip parts of forming images and the photosensitive drums are configured to be set apart in a mono-color image forming mode to be described below. The object thereof is to prevent deterioration and consumption of the photosensitive drums, the recording material conveying belt and the transferring rollers.

Exposure devices (laser scanning devices) 7*a*, 7*b*, 7*c* and 7*d* output from a laser outputting part a laser beam having undergone modulation corresponding with time-series electric digital pixel signal of image information respectively inputted from a host computer. The laser beam outputted from the exposure device brings surfaces of respective photosensitive drums 2*a*, 2*b*, 2*c* and 2*d* charged by respective charging rollers 3*a*, 3*b*, 3*c* and 3*d* into image exposure through a reflection mirror so that electrostatic latent images corresponding with image information are formed on the surfaces of respective photosensitive drums 2*a*, 2*b*, 2*c* and 2*d*.

The recording material conveying belt 8 as a recording material bearing member is tightly stretched between the driving roller 9 and the driven roller (supporting roller) 10 so as to rotary-move in the direction of the arrow (clockwise) by the driving of the driving roller 9.

With respect to the movement direction of the recording material, the upstream side of the image forming part 1M is provided with an adherence roller 11 which brings the recording material P as transferring media to electrostatic adherence onto the recording material conveying belt 8.

With respect to the recording material movement direction, the downstream side of the image forming part 18*k* is provided with a fixing apparatus 12 having a fixing roller (heating roller) 12*a* and a pressing roller 12*b*. That is, in the fixing apparatus, the recording material having born the not-yet fixed toner image formed in the image forming part is sandwiched and conveyed by the fixing nip part formed by the fixing roller 12*a* and the pressing roller 12*b*, heated and pressed by that fixing nip part and thereby the not-yet fixed toner image is fixed onto the recording material.

(2) Full-Color Mode Image Forming Operation

Next, a full-color mode image forming operation by the above described color image forming apparatus will be described.

When an image forming operation starting signal of a full-color mode is generated, the respective photosensitive drums 2*a*, 2*b*, 2*c* and 2*d* are rotary driven at a predetermined process speed and are uniformly charged in the negative polarity by the charging rollers 3*a*, 3*b*, 3*c* and 3*d* respectively. And, the exposure devices 7*a*, 7*b*, 7*c* and 7*d* transform the image signals having undergone color separation inputted from the host computer into optical signals with a laser output part so that the laser beam being the transformed optical signals is brought into scanning and exposure on the charged respective photosensitive drums 2*a*, 2*b*, 2*c* and 2*d* via a reflection mirror and electrostatic latent images are formed on the photosensitive drums.

In addition, first, with respect to photosensitive drum 2*a* where an electrostatic latent image has been formed, magenta toner is brought into electrostatic adherence onto the photosensitive drum in accordance with a charging potential on the photosensitive drum surface by the developing device 4*a* to which a developing bias with the same polarity as the charging polarity (negative polarity) of the photosensitive drum 2*a* has been applied so that the electrostatic latent image is visualized (developed image).

And, the recording material P having been conveyed with a sheet feeding roller (registration roller) 13 in synchronization with that timing is brought into electrostatic adherence by the adherence roller 11 to which adherence bias (polarity opposite from toner (positive polarity)) has been applied onto the surface of the recording material conveying belt 8 driven by the driving roller 9 and is conveyed to the transferring nip part N of the image forming part 1M. And magenta toner image is transferred onto the recording material P by the transferring roller 5*a* to which transferring bias (polarity opposite from toner (positive polarity)) has been applied from a transferring power supply.

The recording material P where the magenta toner image has been transferred is caused to move to the side of the image forming part 1C by the recording material conveying belt 8. And, also in the transferring nip part N of the image forming part 1C, a cyan toner image formed on the photosensitive drum 2*b* is likewise transferred by the transferring roller 5*b* to which a transferring bias (polarity opposite from toner (positive polarity)) has been applied so as to be overlapped onto the magenta toner image on the recording material P.

Subsequently, likewise, yellow and black toner images formed by the photosensitive drums 2*c* and 2*d* of the image forming parts 1Y and 1Bk are brought into sequential multiplex onto magenta and cyan toner images superposingly transferred onto the recording material P by the transferring rollers 5*c* and 5*d* to which transferring bias (polarity opposite from toner (positive polarity)) has been applied with the respective transferring nip parts N and thus a full-color toner image is formed onto the recording material P.

And the recording material P on which a full-color not-yet fixed toner image has been formed is separated from the surface of the recording material conveying belt 8 and conveyed to the fixing device 12 and heated and pressed by the fixing nip part between the fixing roller 12*a* of the fixing device 12 and the pressing roller 12*b* and the not-yet fixed toner image is fixed onto the surface of the recording material P. The fixed recording material is discharged to outside and a series of full-color image forming operations are completed.

Here, normally the recording material conveying belt 8 will never allow a toner image to be born directly onto its surface but may allow toner to attach onto the recording material conveying belt 8 at jamming and fogging and the like to the non-image part and form a detection patch directly onto the recording material conveying belt 8 at the time of operations such as density detection, color registration correction and the like. In order to clean the toner on such a recording material conveying belt 8, such a cleaning process is carried out at a predetermined timing that a cleaning bias in the polarity opposite from that at the time of transfer is applied to the transferring rollers 5*a*, 5*b*, 5*c* and 5*d* in the respective image forming parts 1M, 1C, 1Y and 1Bk and the toner on the recording material conveying belt 8 is transferred to the photosensitive drums 2*a*, 2*b*, 2*c* and 2*d* for collection with drum cleaning devices 6*a*, 6*b*,6*c* and 6*d*.

In addition, the image forming apparatus is provided with an atmosphere sensor 50 in its inside, which is configured to be capable of changing conditions of charging, development, bias for transferring and fixing in accordance with atmospheric environments (temperature and moisture) inside the image forming apparatus. That is, the atmosphere sensor 50 is used for adjusting density of toner images formed on the recording material P and attaining optimum transferring and fixing conditions.

In addition, the image forming apparatus is provided with a media sensor 51 which is configured to be capable of discriminating the recording material P and thereby changing transferring bias and conditions of fixing in accordance with recording material. That is, the media sensor 51 is used for attaining optimum transferring and fixing conditions for the recording material P.

(3) Mono-Color Mode Image Forming Operation

The present color image forming apparatus is configured so that a mono-color mode of forming mono-color toner images (second mode) is selectable in addition to the above described full-color mode (first mode). The present embodiment will be described in use of a mono-color mode in the most frequently used black mono-color. However, the present invention will not limit the mono-color mode to the black mono-color.

In the case where the mono-color mode is selected, only an image forming part (second image forming part) 1Bk forming a black image is operated likewise the above described full-color mode and the other image forming parts (first image forming parts) 1M, 1C and 1Y are operated as follows.

An image forming operation in a mono-color mode will be described below.

When a signal of starting image forming operation in a mono-color mode is generated, transferring rollers 5*a*, 5*b* and 5*c* of the image forming parts 1M, 1C and 1Y move in a direction of departing respective photosensitive drums 2*a*, 2*b* and 2*c* with contact/separation controlling means. The developing rollers 4*a*, 4*b* and 4*c* are also spaced apart from the respective photosensitive drums 2*a*, 2*b* and 2*c*. The spaced-apart developing rollers 4*a*, 4*b* and 4*c* are not driven for rotation and thereby deterioration and consumption of respective developing rollers and toner in respective colors is prevented. In addition, likewise the spaced-apart transferring rollers 5*a*, 5*b* and 5*c* are spaced apart also from the recording material conveying belt 8, originally will not rotate voluntarily and will enter a halting state so that such a state occurs that no transferring bias is applied. Accompanied by movement of the transferring rollers 5*a*, 5*b* and 5*c*, the recording material conveying belt 8 also moves in a direction so as to leave the photosensitive drums 2*a*, 2*b* and 2*c* and thus the recording material conveying belt 8 leaves the photosensitive drums 2*a*, 2*b* and 2*c* and therefore the photosensitive drums 2*a*, 2*b* and 2*c* and the recording material conveying belt 8 do not form any transferring nip part.

As described above, deterioration and consumption of the developing rollers 4*a*, 4*b* and 4*c*, the transferring rollers 5*a*, 5*b* and 5*c* and the recording material conveying belt 8 is prevented.

Figure 4:
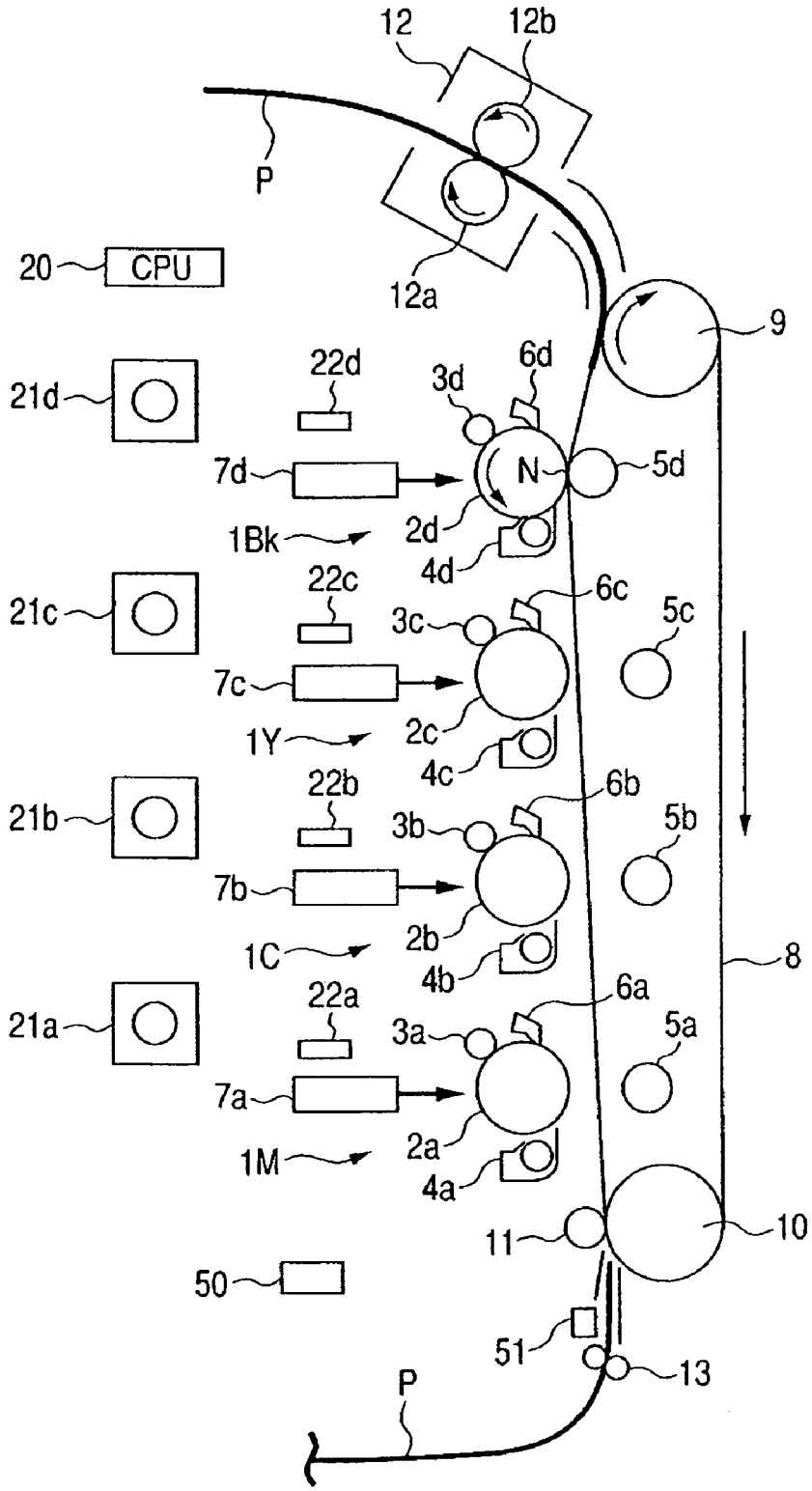
FIG. 4 is a diagram showing a color image forming apparatus being another embodiment of the present invention.

The rotary operation of the photosensitive drums 2*a*, 2*b* and 2*c* at the time of a mono-color mode will be described below. FIG. 4 shows a schematic configuration of the image forming apparatus at the time of mono-color mode in which implementation of the above described separation is carried out.

The black-color image forming part 1Bk implements image forming likewise the one in the full-color mode.

The recording material P conveyed with a sheet feeding roller (registration roller) 13 likewise the one in the full-color mode undergoes electrostatically adhered to the surface of the recording material conveying belt 8 with an adherence roller 11 to which an adherence bias (with polarity opposite from toner (positive polarity)) is applied to pass through the spaced-apart image forming parts 1M, 1C and 1Y to be conveyed to reach a transferring nip part N of the image forming part 1Bk. And a black toner image is transferred onto the recording material P by a transferring roller 5*d*, to which the transferring bias has been applied, in the transferring nip part N of the image forming part 1Bk.

Being separated from the surface of the recording material conveying belt 8, the recording material P where the black toner image has been formed is conveyed to the fixing apparatus 12 to undergo heating and pressing with the fixing nip part of the fixing apparatus 12 so that a not-yet fixed toner image undergoes heat fixing onto the recording material P and is thereafter ejected to the outside and a series of mono-color image forming operation is completed.

A rotary operation of the photosensitive drums 2*a*, 2*b* and 2*c* at the time of mono-color in the present embodiment will be described below.

A number of printing sheets in a mono-color mode is stored inside a RAM 212 and an EEPROM 213 inside the controlling portion 20. And in accordance with a certain number of printing sheets in a predetermined interval, the photosensitive drums 2*a*, 2*b* and 2*c* are caused to carry out tiny rotation.

Figure 5:
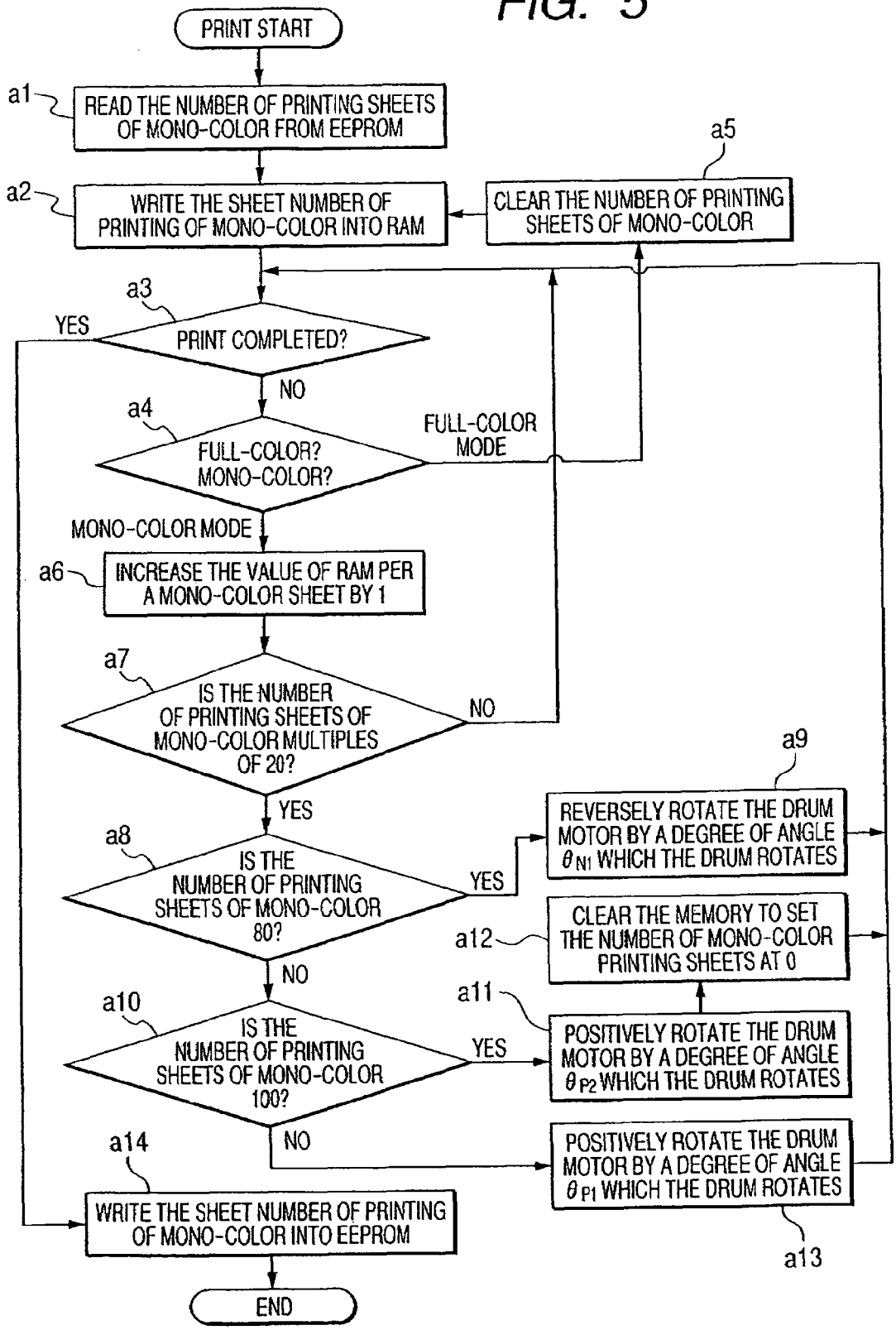
FIG. 5 is a flow chart related to idling photosensitive drums at the time of a mono-color mode.

FIG. 5 is a flow chart describing an updating process on the number of printing sheets stored in an EEPROM 213 and a RAM 212 in a mono-color mode and a rotary operation of photosensitive drums 2*a*, 2*b* and 2*c*. Here, the recording material is a normal sheet and atmospheric environments of the image forming apparatus are set to the temperature of 30° C. and the moisture of 80% Rh. The program of executing this process is stored in the ROM 211. The flow chart will be described below. Starting up a printing process, that process starts.

In Step a1, the number of printing sheets of mono-color stored in the EEPROM 213 (initial value is 0 and a printing history in the past if there is any is stored) is read.

Next the step goes forward to Step a2 so that the number of printing sheets of mono-color is written into RAM 212.

Next in Step a3, it is checked whether or not a printing job is currently underway. If the printing job is underway, the step goes forward to Step a4 so that it is checked whether the current printing mode is the full-color mode or the mono-color mode. In case of the full-color mode, the step goes forward to Step a5 so that the memory is cleared to set the number of printing sheets of mono-color at 0 and again the step goes forward to Step a2 so that the number of printing sheets of mono-color sheet is written into RAM 212 (0 is written). And completion of the print job or assignment to the mono-color mode is waited for.

In the case where the printing mode currently being underway in Step a4 is the mono-color mode, the step goes forward to Step a6 so as to increase the value of RAM 212 by 1 whenever a sheet of mono-color mode printing is implemented.

Next, the step goes forward to Step a7 so that it is checked whether or not the number of printing sheets of mono-color in RAM 212 is multiples of 20. In the case where multiples of 20 are not counted, counting of the number of printing sheets of mono-color is repeated through Step a3 (a4, a5) again until the number of printing sheets of mono-color becomes multiple of 20.

When counting reaches multiples of 20 in Step a7, the step goes forward to Step a8 so that it is checked whether the number of printing sheets of mono-color being multiples of 20 is 80 or not. In case of 80 sheets the step goes forward to Step a9 so that the drum motors 21*a*, 21*b* and 21*c* are driven on a small level so as to rotate the photosensitive drums 2*a*, 2*b* and 2*c* by a degree of angle of 58° in a direction opposite to a rotary direction at the time of the color-mode (that is, θN1=58° in FIG. 6). And, likewise, counting of the number of printing sheets of mono-color is repeated through Step a3 (a4, a5) again until the number of printing sheets of mono-color becomes multiples of 20.

In the case where the number of printing sheets of mono-color being multiples of 20 is not 80 in Step a8, the step goes forward to Step a10 so that it is checked whether the number of printing sheets of mono-color being multiples of 20 is 100 or not. In case of 100 sheets the step goes forward to Step a11 so that the drum motors 21*a*, 21*b* and 21*c* are driven on a tiny level so as to rotate the photosensitive drums 2*a*, 2*b* and 2*c* by a degree of angle of 77° in the same direction as a rotary direction at the time of the color-mode (that is, θP2=77° in FIG. 6). And the step goes forward to Step a12 so that the memory is cleared to set the number of printing sheets of mono-color at 0. That is, here, the maximum value of sheet counting of the number of printing sheets of mono-color is 100. Likewise, counting of the number of printing sheets of mono-color is repeated through Step a3 (a4, a5) again until the number of printing sheets of mono-color becomes multiples of 20.

In the case where the number of printing sheets of mono-color being multiples of 20 is not 100 in Step a10, since it is determined that the number of printing sheets of mono-color is multiples of 20 other than 80 and 100 in Step a8 and a10, the number of printing sheets of mono-color will be 20 sheets or 40 sheets or 60 sheets. At that time, the step goes forward to Step a13 so that the drum motors 21*a*, 21*b* and 21*c* are driven on a tiny level so as to rotate the photosensitive drums 2*a*, 2*b* and 2*c* by a degree of angle of 16° in the same direction as a rotary direction at the time of the color-mode (that is, θP1=16° in FIG. 6). And, likewise, counting of the number of printing sheets of mono-color is repeated through Step a3 (a4, a5) again until the number of printing sheets of mono-color becomes multiples of 20.

In the case where the current printing job is completed in Step a3, the step goes forward to Step a14 so that the sheet number of printing of mono-color stored in the RAM 212 is written into the EEPROM 213 and the process is completed.

Summarizing the above description, at the time of full-color mode in a normal sheet mode, the number of printing sheets of mono-color is not counted or by then the memory is cleared to set the number of printing sheets of mono-color at 0. At the time of mono-color mode, the number of printing sheets of mono-color is counted and tiny rotation is carried out every 20 sheets.

At the time of mono-color mode, the photosensitive drums 2*a*, 2*b* and 2*c* rotate every predetermined interval. That is, at the time of mono-color mode, photosensitive drums 2*a*, 2*b* and 2*c* start rotation from the state of a rotation halt and thereafter rotation is halted. At that time, the rotation amount of the photosensitive drums 2*a*, 2*b* and 2*c* for once is less than one rotation. Here, a predetermined interval will include an interval in terms of the number of sheets of recording material as a criterion or in terms of time when recording material is transported as a criterion.

Also in the case where such an operation is repeated to implement continuous paper feeding at the time of a mono-color mode, the photosensitive drums will not expose the same surfaces, and therefore, give rise to no mark due to sliding so that high quality image can be derived.

In addition, since rotation of the photosensitive drums is intermittent rotation and the rotation amount thereof for a unit is less than one rotation, deterioration of the photosensitive drums can be restrained.

Figures 6, 7:
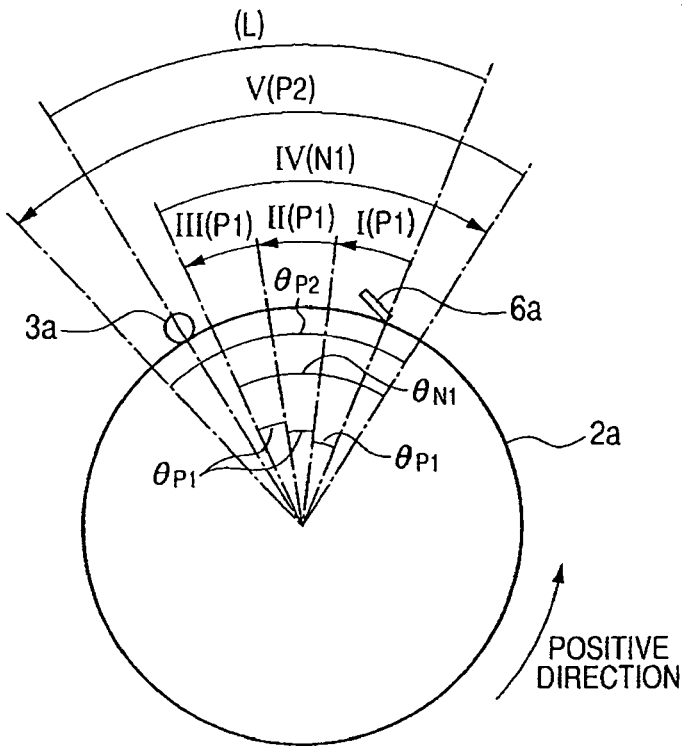
FIG. 6 is a diagram showing rotary operation of a photosensitive drum at the time of a mono-color mode.
FIG. 7 is a table showing predetermined intervals with which the photosensitive drums are driven under respective conditions at the time of a mono-color mode.

FIG. 6 shows a schematic diagram of operation of an image forming part 1M at the time of mono-color mode. As shown in FIG. 6, the photosensitive drums are caused to rotate by 16° as tiny rotation in every 20 sheets up to 3 times from rotations (I) to (III). For the fourth time, a reversed rotation (IV) by 58° is carried out. Here, the reverse rotation takes place because residual toner, additives and the like left at the tip part of a cleaning blade 6*a* are extremely tiny amount at the time of starting up the photosensitive drums, but sneak through to occasionally pollute the charging rollers 3*a*, 3*b* and 3*c* and occasionally give rise to image defects accompanied by the charging defects. That is, that is why a life as an image forming part is shortened. Therefore, before the matter that has sneaked through the cleaning blade 6*a* at the time of starting up (I) reaches the charged rollers, reverse rotation is carried out so as to implement operation to pull it back to the side ahead of the cleaning blade.

And a rotation of 77° is carried out for the fifth time so that the matter that has sneaked through but pulled back to the original position makes a rush through the charging roller 3*a*.

In the present embodiment, in view from the center of the photosensitive drums, a degree of angle between the tip part of the cleaning blade and the charging roller is 55°.

Therefore, the movement portion of 48° due to positive rotating operations (directions) (I) to (III) is smaller than 55° being the degree of angle between the tip part of the cleaning blade and the charging roller, that is, the matter that has sneaked through at the time of stating up (I) will never reach the charging roller. In addition, the movement portion of 58° due to reversely rotating operation (IV) is larger than 48° being the movement portion due to forward rotating operations (positive directions) (I) to (III), that is, the matter that has sneaked through at the time of stating up (I) will be pulled back to the front side (upstream side) than the cleaning blade. Moreover, the movement portion of 67° (=3×16−58+77) due to the operations (I) to (V) is larger than 55° being the degree of angle between the tip part of the cleaning blade and the charging roller, that is, such a relationship is established that the location having been pulled back to the front side than the cleaning blade in the operation IV passes the charging roller in a rush.

That is, as shown in FIG. 6, taking L as distance between the cleaning device and the charging device in the rotating direction of a photosensitive drum (first image bearing member); P1 as movement distance due to positive rotation (rotation in the first direction) of the photosensitive drum; N1 as movement distance due to reverse rotation (rotation in the second direction) of the photosensitive drum; and P2 as movement distance due to positive rotation of the photosensitive drum different from the movement distance P1, the following equations are established. Here, in FIG. 6, (P1), (N1), (P2) and (L) designated distance on the periphery of the photosensitive drum.

$$n \times P1 < L$$

$$n \times P1 < N1$$

$$n \times P1 - N1 + P2 > L$$

(wherein, n is a natural number)

Thus, in the case where ten times of simply forward rotation (positive direction) is implemented, the matter that has sneaked through the cleaning blade seven times for the tenth time after the fourth time will pass the charging roller but, in contrast, the present embodiment in use of the above described method can derive such an effect that twice will do so as to be able to restrain pollution of the charging roller.

Also in the case where such an operation is repeated to implement continuous paper feeding at the time of a mono-color mode, the photosensitive drums will not exposure the same surfaces, and therefore, give rise to no mark due to sliding so that high quality image can be derived.

Next, process speed in respective printing modes will be described.

The present embodiment will have eight kinds of printing mode in total since there are four sheet type modes of a thin sheet mode, a normal sheet mode, a thick sheet mode and a rough sheet mode according to types of recording material and there are a full-color mode and a mono-color mode for each of them.

Since fixing feasibility depends on types of recording material, throughput (number of output sheet per unit time) that can undergo fixing is set in accordance with the respective types and in order to attain 25 ppm for a thin sheet, 20 ppm for a normal sheet and 15 ppm for a thick sheet and a rough sheet, process speed is 150 mm/sec for a thin sheet mode, 120 mm/sec for a normal sheet mode and 90 mm/sec for a thick sheet mode and a rough sheet mode. The process speed hereof is determined based on fixing performance and the same speed is set for the full-color mode and the mono-color in the present embodiment.

And in the present embodiment, the process speed at the time of tiny driving at the time of mono-color mode (however, this is the speed to be regarded as a target and, since the time when a motor starts up is the time when rotation starts up, the speed is slow) is unified into 120 mm/sec despite the sheet type modes. This is for the purpose of simplifying the operation and due to adoption of a single sequence in order not to complicate the operation during printing.

In addition, in the present embodiment, the interval for carrying out tiny driving is changed depending on sheet types. The reason hereof is that sliding between the photosensitive drums 2*a*, 2*b* and 2*c* and the recording material is apt to occur in case of using recording material such as a rough sheet that is hardly adhered to the recording material conveying belt and in case of using recording material such as a thin sheet with insufficient resiliency and apt to go astray from a sheet conveyance path.

Moreover, in the present embodiment, the interval of carrying out tiny driving is changed in accordance with atmospheric environments of the image forming apparatus. The reason hereof is that the recording material gets hardly adhered to the recording material conveying belt and therefore sliding thereof on the photosensitive drums 2*a*, 2*b* and 2*c* is apt to occur in the case where moisture of the atmospheric environments is high. The reason thereof is also that, since resistance of the recording material gets lower, a voltage applied to the adherence roller 11 makes leak current transmit through the recording material and be apt to flow into the photosensitive drums.

FIG. 7 shows intervals of a number of printing sheets for carrying out tiny driving of the photosensitive drums 2*a*, 2*b* and 2*c* according to respective atmospheres and respective sheet type mode at the time mono-color mode. In order to describe atmospheric state, reference character L/L denotes low temperature with low moisture, reference character N/N denotes normal temperature with normal moisture and reference character H/H denotes high temperature with high moisture.

Thus, changing the interval for carrying out tiny driving in accordance with sheet types and atmospheric environments, an optimum coinciding condition can be derived to prevent both of consumption of image forming parts of color toner and sliding of the photosensitive drums in case of continuous mono-color printing.

(4) Image Output Experimental Result

At first, an image output result of the present embodiment will be described.

As experimental conditions, continuous sheet feeding is carried out under respective atmospheric environments (L/L: 15° C., 10% Rh, N/N: 23° C., 55% Rh, H/H: 30° C., 80% Rh,) in respective sheet type modes (thin sheet mode, normal sheet mode, thick sheet mode and rough sheet mode) of mono-color mode and sampling (magenta, cyan, yellow with 25% half tone image) of a full-color mode every 20 sheets., 50 sheets, 100 sheets, 200 sheets, 500 sheets, 1000 sheets, 2000 sheets and 5000 sheets respectively. Here, there used is Office Planner (Canon Marketing Japan Inc., product name) with basic weight of 64 g/$m^2$ as thin sheet, CLC Color Laser Copier paper stock (Canon Marketing Japan Inc., product name) with basic weight of 80 g/$m^2$as normal sheet, New NPI Bond 128 g (Nippon Paper Group, Inc., product name) with basic weight of 128 g/$m^2$ as thick sheet, Fox River Bond (Fox River, product name) with basic weight of 90 g/$m^2$ as rough sheet.

The sampling images in a full color mode were allocated to respective ranks of "O" for a case where no image defects occurred due to sliding; "OΔ" for a case where they could be confirmed slightly; "Δ" for a case where they could be confirmed; "ΔX" for a case where images were a little bad and "X" for a case where images were bad.

An image output result in case of the present embodiment will be described.

FIG. 8 shows an experimental result of respective atmospheres of respective sheet type mode in case of Embodiment 1 in accordance with the above described embodiment 1. In case of Embodiment 1, without depending on the respective atmospheres of respective sheet type mode, no image defects due to sliding occurred over printing of 5000 sheets.

Thus, in case of the present embodiment, also in the case where mono-color printing continued, occurrence of image defects due to sliding on the photosensitive drums could be prevented at the time of subsequent color printing without sacrificing consumption of image forming parts of color toner so that images with a high image quality could be derived.

Next, an image output result of Comparison Example without carrying out tiny rotations of the photosensitive drums will be described. FIG. 9 shows an experimental result of respective atmospheres of respective sheet type mode in case of Comparison Example.

In Comparison Example, mono-color printing image defects due to sliding occurred when printing of several hundreds of sheets was carried out in a continuous fashion. In particular, image defects of a bad level occurred under the atmosphere with high temperature and high moisture.

Here, FIG. 10 shows an image output result of Embodiment 2 to which the present invention has been applied and a tiny rotation likewise Embodiment 1 is carried out. However, a degree of angle of the tiny driving differs from that in Embodiment 1. In particular, while θP1=16°, θP2=58° and θN1=77° are provided in Embodiment 1, θP1=15°, θP2=60° and θN1=75° are provided in Embodiment 2.

Also in Embodiment 2, image defects due to sliding on the photosensitive drums can be restrained. However, nothing on a problematic level will occur for actual use, but subject to strict check, slight image deterioration due to sliding was confirmed when mono-color printing in excess of 1000 sheets in a continuous fashion under an atmosphere with high temperature and high moisture in Embodiment 2.

How the result of Embodiment 2 differs from that of Embodiment 1 will be described with reference to FIG. 11A and FIG. 11B.

Figure 11A:
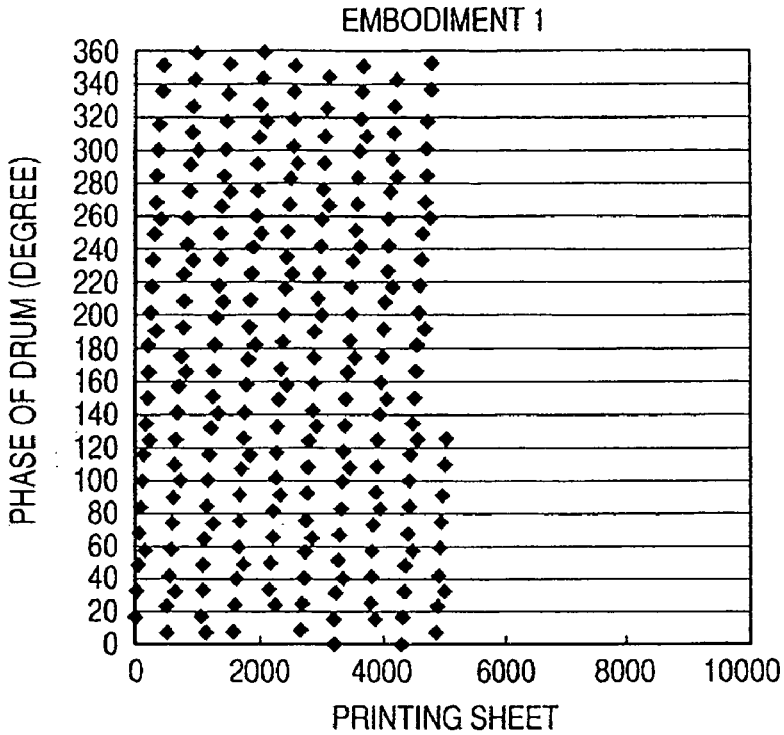
FIGS. 11A and 11B are graphs spotting phases of sliding parts of photosensitive drums against printing sheets in Embodiments 1 and 2.
Figure 11B:
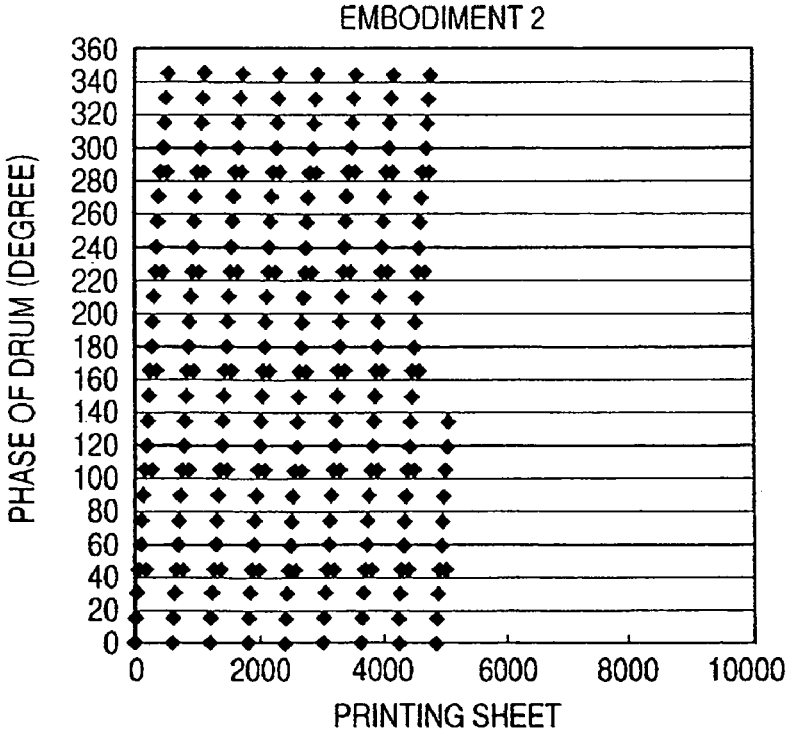

As shown in FIG. 11B, in case of taking a tiny rotation amount of Embodiment 2, the photosensitive drums will continue rotating in such a state that the phases are synchronized when tiny rotation repeats, and although tiny rotation is carried out, the photosensitive drums will be brought into sliding on the same surface once in several times, and therefore if further accurate prevention of image defects is intended, Embodiment 1 in FIG. 11A is more preferable.

As described above, the present embodiment is designed to count the number of printing sheets of mono-color at the time of mono-color (black) image forming (second mode) to carry out tiny rotation in every predetermined number of sheets, and therefore, image defects due to sliding on the photosensitive drums can be prevented from occurring at the time of subsequent full-color printing without sacrificing consumption of image forming parts of color toner also in the case where mono-color printing continued so that images with higher image quality can be derived.

EMBODIMENT 2

The present embodiment is designed to apply a voltage to a charging roller of an image forming parts of color toner at the time of counting the number of printing sheets of mono-color at the time of mono-color (black) image forming (second mode) when to carry out tiny rotation in every predetermined number of sheets. Thereby, the present embodiment cancels current flowing into the photosensitive drums when recording material (or recording material conveying belt) slides on the photosensitive drums in the case of mono-color print to prevent occurrence of memory mark so that images with higher image quality can be derived. A method thereof will be described below.

In the present embodiment configuration of an image forming apparatus is schematically the same as that of Embodiment 1, and different parts will be described.

In the present embodiment, tiny rotation is not configured to repeat rotation in the positive direction (positive rotation), the reverse direction and the like but to rotate the photosensitive drums 2*a*, 2*b* and 2*c* by 16° at a time in the direction of positive rotation every predetermined number of sheets as shown in FIG. 7. This is applicable to a case where pollution can hardly occur in the charging rollers 3*a*, 3*b* and 3*c* due to toughness against the material used as toner and pollution of the charging rollers 3*a*, 3*b* and 3*c* and the life of the image forming parts and is advantageous since the operation can be simplified.

In the present embodiment, under an H/H atmosphere that is apt to generate memory marks onto photosensitive drums with current having flowed from the adherence roller 11 at the time when the photosensitive drums 2*a*, 2*b* and 2*c* and the recording material P have been brought into sliding, at the time when no tiny rotation is being carried out, the charging bias power supply is designed not to apply an voltage to the charging rollers 3*a*, 3*b* and 3*c* of the color toner image forming parts but to apply a predetermined voltage to the charging rollers 3*a*, 3*b* and 3*c* during tiny rotation.

At the normal time, while potential on the surface of the photosensitive drums 2*a*, 2*b* and 2*c* is −400 V in average after the charging rollers 3*a*, 3*b* and 3*c* having applied voltage have passed by, it is known that potential on the surface of the photosensitive drums of the memory mark corresponding portion reaches approximately −385 V at the time when a memory mark where density gets thick occurs due to current flowing in at the time when the photosensitive drums 2*a*, 2*b* and 2*c* and the recording material P are brought into sliding. This is caused by voltage with a positive polarity having been applied to the adherence roller 11 is transmitted through the recording material with low resistance to end in making charges with positive polarity flow through the photosensitive drums, thus lowering the potential of the photosensitive drums. In particular, these phenomena are remarkably apt to occur in case of an atmosphere with higher temperature and moisture and in case of using recording material with lower resistance.

Therefore, in the present embodiment, the charging bias power supply was not designed to apply a voltage to the charging roller prior to tiny rotation but the charging bias power supply was designed to apply to the charging roller −465 V being a value subject to addition of approximately −450V being an discharge starting voltage to approximately −15V in the sliding part in midst of the tiny rotation so as to be capable of compensating a portion of approximately −15V being the potential difference of the memory generating part to the charging rollers 3*a*, 3*b* and 3*c* of the image forming parts of color toner at the time of carrying out tiny rotation.

Such an arrangement enables cancellation of changes in potential of the photosensitive drums 2*a*, 2*b* and 2*c* due to current having flown in at the time when the recording material slides on the photosensitive drums 2*a*, 2*b* and 2*c* in the case of mono-color print and occurrence of memory mark can be prevented.

The reason why a positive polarity was adopted for the polarity of the voltage to be applied to the adherence roller 11 is that it is advantageous to charge the recording material P to the positive polarity prior to transferring and thereby enable transferring at a lower transferring voltage at the time of subsequent transferring and it serves advantage of enabling control of the above described charging bias application by bias applying means for use in a normal image forming apparatus as in 0 V prior to rotation and −465 V at a site corresponding with sliding in midst of rotation. That is, no output circuit in a polarity opposite from the polarity being originally used in a high voltage circuit for applying a voltage to the charging roller should be added so that controlling configuration can be simplified.

In contrast, in the case where a voltage in the opposite polarity was applied to the adherence roller 11, corresponding with the memory mark (thin color part) where density gets thin, since a charging bias in the positive polarity is applied, the circuit will become complicated further or otherwise, in order to compensate the portion of difference around +15 V, such a control of −465 V outside the site corresponding with sliding in midst of rotation and 0 V at the site corresponding with sliding in midst of rotation is required, and implementation of control as described above in such a system of repeating halting and rotation will increase a degree of difficulty to an extreme extent. Failure in applying a voltage timely, memory will occur in turn. Therefore, it can be remarked preferable that the polarity of the voltage to be applied to the adherence roller 11 is in a positive polarity.

As described above, the present embodiment is designed to apply a voltage to a charging roller of an image forming parts of color toner at the time of counting the number of printing sheets of monochromatic-color at the time of mono-color (black) image forming (second mode) when to carry out tiny rotation in every predetermined number of sheets, and thereby changes in potential of the photosensitive drums 2*a*, 2*b* and 2*c* due to current having flown in at the time of sliding on the photosensitive drums at the time of mono-color printing are cancelled so that occurrence of memory mark can be prevented and images with higher image quality can be derived.

EMBODIMENT 3

The present embodiment is designed to count the number of printing sheets of mono-color at the time of mono-color (black) image forming (second mode) to carry out tiny rotation in every predetermined number of sheets also in the case where an image forming apparatus is in an intermediate transferring member system. Therefore, image defects due to sliding on the photosensitive member drums can be prevented from occurring at the time of subsequent full-color printing without sacrificing consumption of image forming parts of color toner also in the case where mono-color printing continued so that images with higher image quality can be derived. A method thereof will be described below.

Figure 12:
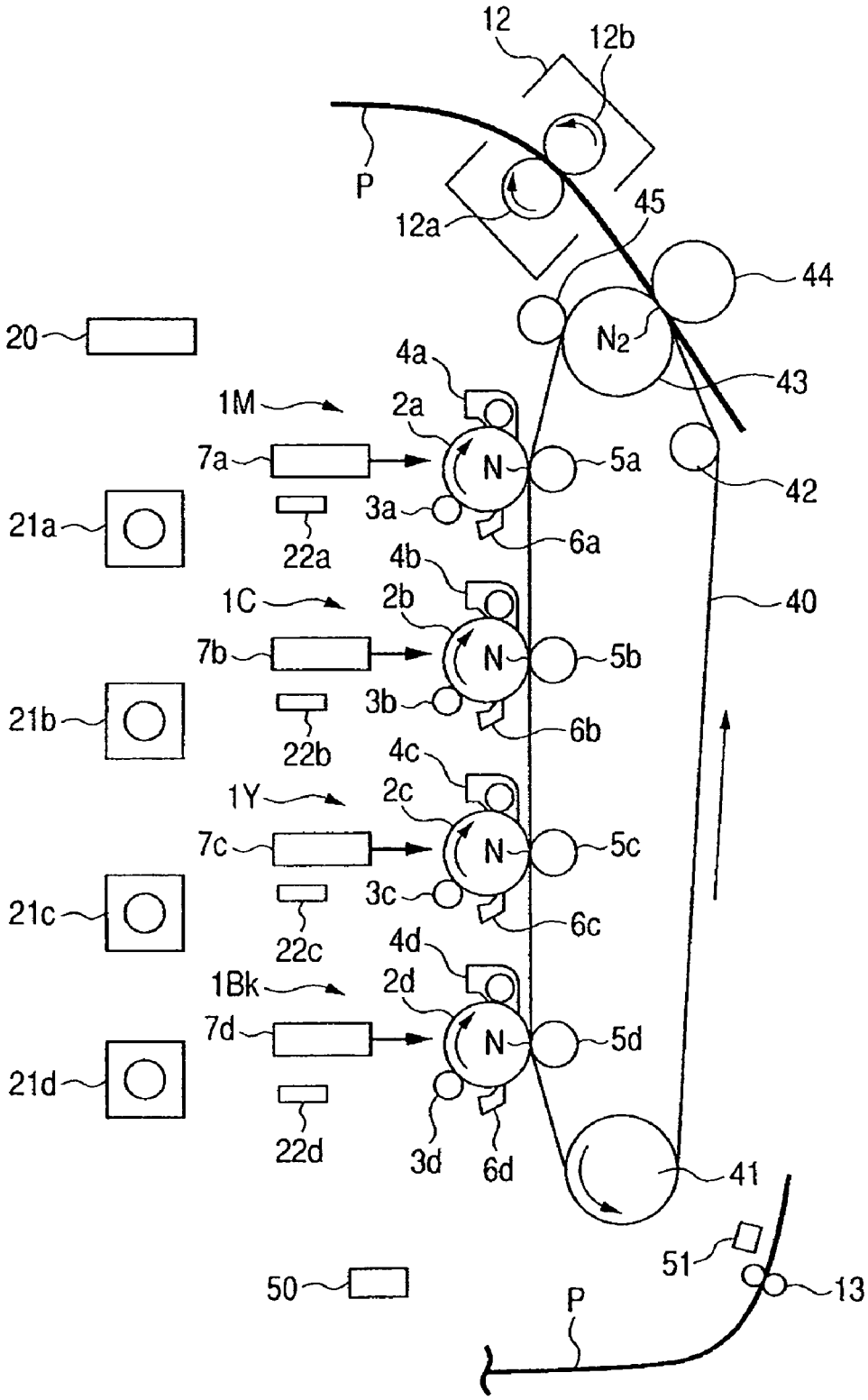
FIG. 12 is a diagram showing a color image forming apparatus being still another embodiment of the present invention.

FIG. 12 is a schematic configuration diagram showing an image forming apparatus related to Embodiment 3 of the present invention. Here, like reference characters designate the same or similar members throughout the figures and characters thereof so that repeated description will be omitted.

The present embodiment is a color image forming apparatus in use of intermediate transferring system of sequentially overlapping toner images in respective colors formed on respective four photosensitive drums on an intermediate transferring belt as an intermediate transferring member to transfer them collectively with a secondary transferring part onto recording material.

In this color image forming apparatus, respective photosensitive drums 2*a*, 2*b*, 2*c* and 2*d* of image forming parts 1M, 1C, 1Y and 1Bk contact an endless belt type intermediate transferring member (intermediate transferring belt) 40 being a transferring device in respective primary transferring nip parts N. The intermediate transferring belt 40 is tightly stretched across a driving roller 41, a driven roller (supporting roller) 42 and a secondary transferring opposite roller 43 and is caused to move to rotate in the direction of an arrow (counterclockwise) by drive of the driving roller 41.

The respective transferring rollers 5*a*, 5*b*, 5*c* and 5*d* for primary transferring contact the respective photosensitive drums 2*a*, 2*b*, 2*c* and 2*d* through the intermediate transferring belt 40 in the respective primary transferring nip parts N. The secondary transferring opposite roller 43 contacts the secondary transferring roller 44 through the intermediate transferring belt 40 to form the secondary transferring nip portion N2. The secondary transferring roller 44 is provided to separably contact the intermediate transferring belt 40.

As a belt cleaning device for removing and collecting transferring residual toner remaining on the surface of the intermediate transferring belt 40, the charging roller (contact charging member) 45 being a charging member for cleaning contacts the vicinity of the secondary transferring opposite roller 43 outside the intermediate transferring belt 40 and a power supply for cleaning is caused to connect to this charging roller for cleaning. That is, the belt cleaning device is configured by the charging roller 45 for cleaning and the power supply for cleaning.

In addition, a fixing device 12 having a fixing roller 12*a* and a pressing roller 12*b* is provided in the downstream side of the secondary transferring nip part N2 in the direction of conveying recording material P.

Next, an image forming operation by the color image forming apparatus of the present embodiment will be described.

When an image forming operation starting signal is generated, the respective photosensitive drums 2*a*, 2*b*, 2*c* and 2*d* of the image forming parts 1M, 1C, 1Y and 1Bk to be driven to rotate at a predetermined process speed are uniformly charged to a negative polarity by the charging rollers 3*a*, 3*b*, 3*c* and 3*d* respectively. And the exposure devices 7*a*, 7*b*, 7*c* and 7*d* transform inputted image signals subject to color separation to optical signals with a laser output part and the laser beams being transformed optical signals scan and expose on the surfaces of the charged respective photosensitive drums 2*a*, 2*b*, 2*c* and 2*d* to form an electrostatic latent images onto the photosensitive drums.

And, at first, with respect to the photosensitive drum 2*a* on which the electrostatic latent image has been formed, magenta toner is electrostatically adhered in accordance with charging potential on the photosensitive drum surface with a developing device 4*a* to which a developing bias in the same polarity as the charging polarity (negative polarity) of the photosensitive drum 2*a* has been applied so that the electrostatic latent image is visualized (developed image). This magenta toner image undergoes primary transferring onto the rotating intermediate transferring belt 40 with the transferring roller 5*a* to which a primary transferring bias (opposite polarity to the toner (positive polarity)) has been applied in the primary transferring nip part N. The intermediate transferring belt 40 to which the magenta toner image has been transferred is caused to move to rotate to the side of the image forming part 1C.

And, also in the image forming part 1C, a cyan toner image formed onto the photosensitive drum 2*b* likewise the above described event is transferred onto the magenta toner image on the intermediate transferring belt 40 in an overlapped fashion in the primary transferring nip part N.

Subsequently, likewise, yellow and black toner images formed in the photosensitive drums 2*c* and 2*d* of the image forming parts 1Y and 1Bk are transferred so as to be sequentially overlapped onto the magenta and cyan toner images subject to multiples transfer onto the intermediate transferring belt 40 in the respective primary transferring nip parts N so that a full-color toner image is formed on the intermediate transferring belt 40.

And in synchronization with timing when tip of a full-color toner image on the intermediate transferring belt 40 is caused to move to the secondary transferring nip part N2, the recording material P is conveyed to the secondary transferring nip part N2 with a sheet feeding roller (registration roller) 13. And the recording material P undergoes collective secondary transferring of the full-color toner image with the secondary transferring roller 44 to which a secondary transferring bias (in the opposite polarity to the toner (positive polarity)) has been applied. The recording material P on which the full-color toner image has been formed is conveyed to the fixing apparatus 12 so as to undergo heating and pressing in the fixing nip parts between the fixing roller 12*a* and the pressing roller 12*b* so that a full-color toner image is heated and fixed onto the surface of the recording material P and thereafter is discharged to outside to complete a series of image forming operations.

At the time of the above described primary transferring, primary transferring residual toner remaining on the photosensitive drums 2*a*, 2*b*, 2*c* and 2*d* are removed and collected by the drum cleaning devices 6*a*, 6*b*, 6*c* and 6*d*. In addition, the secondary transferring residual toner left on the intermediate transferring belt 40 subject to secondary transferring is collected by the belt cleaning devices in such a fashion as described below.

The belt cleaning device is designed to use the charging roller 45 being a contact charging member, be caused to contact the intermediate transferring belt 40 and simultaneously charge the secondary transferring residual toner as well by supplying current from a power supply for cleaning not shown in the drawing. The charging roller 45 for discharging/charging the secondary transferring residual toner will be referred to as ICL roller 45 in order to discriminate it from the charging rollers 3*a*, 3*b*, 3*c* and 3*d* contacting the photosensitive drums 2*a*, 2*b*, 2*c* and 2*d*.

The secondary transferring residual toner layer subject to secondary transferring undergoes compulsory charging with discharge of the ICL roller 45. This enables so-called transfer-simultaneous cleaning so that the transferring residual toner of the prior image is caused to transfer to the photosensitive drums while the subsequent image is undergoing primary transferring in the primary transferring nip part.

Likewise the color image forming apparatus described in Embodiment 1, the present embodiment is configured to be capable of selecting mono-color (black mono-color) image forming mode beside the above described full-color image forming mode.

Figure 13:
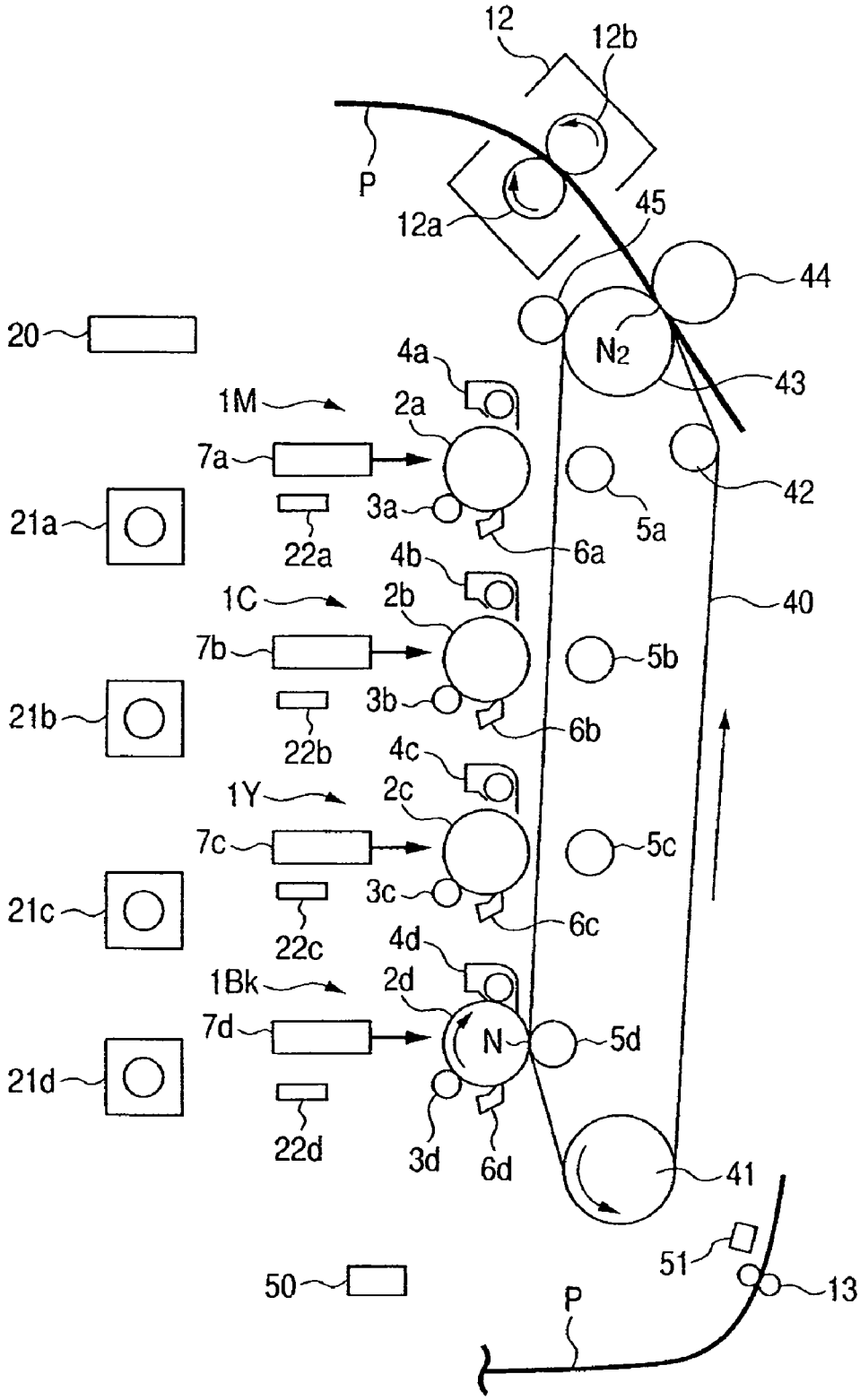
FIG. 13 is a diagram showing a state of setting a intermediate transferring belt apart at the time of a mono-color mode.

Operations of setting the image forming parts spaced apart in a mono-color mode in order to prevent deterioration and consumption are likewise Embodiment 1. FIG. 13 shows a schematic configuration diagram of an image forming apparatus at the time of mono-color mode subject to spacing operation.

And also in the present embodiment, the photosensitive drums 2*a*, 2*b* and 2*c* are caused to carry out tiny rotation in accordance with the number of printing sheets of mono-color mode. This operation is also likewise Embodiment 1.

In the present embodiment, the interval for carrying out tiny driving does not have to be changed depending on sheet types. The reason thereof is that recording material P will never be conveyed in the vicinity of the photosensitive drums 2*a*, 2*b* and 2*c*. However, in the present embodiment, the interval for carrying out tiny driving is changed depending on atmospheric environments of the image forming apparatus as in Embodiment 1. The reason thereof is that an atmospheric environment with high moisture will lower resistance of the intermediate transferring belt 40 and thereby leak current having traveled through the intermediate transferring belt 40 is apt to flow into the photosensitive drums.

In addition, under an atmosphere with higher temperature and higher moisture, a belt will be apt to get further extendable mechanically and when a short part reinforcing tape is put on, that portion will not extend but the center part extends, which will give rise to a waved shape at the time when the belt is tightly stretched and sliding on the photosensitive drum 2*a*, 2*b* and 2*c* is apt to occur. Moreover, a belt kept in storage for a long period in an atmosphere with high temperature and high moisture is apt to give rise to a core set mark corresponding with the tightly stretched roller site and may get apt to slide on the photosensitive drums 2*a*, 2*b* and 2*c*.

Due to the above described reason, the interval for carrying out tiny driving is arranged to get short under the atmosphere with high temperature and high moisture.

Figures 14, 15:
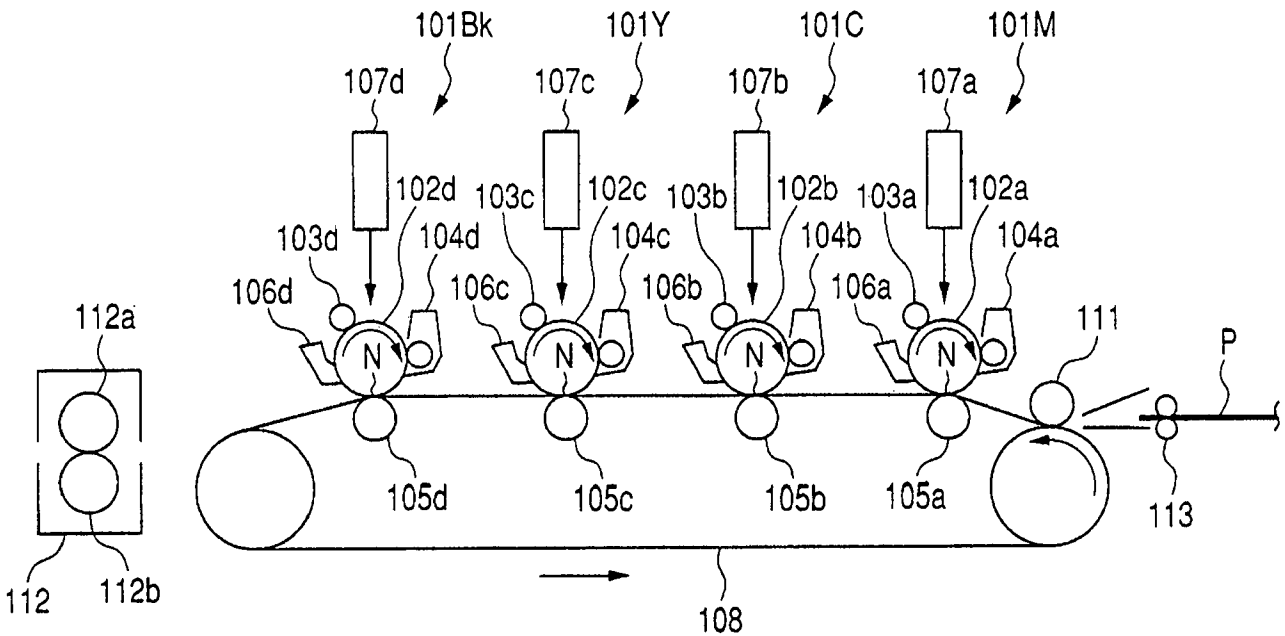
FIG. 14 is a table showing predetermined intervals with which the photosensitive drums are driven under atmospheric conditions at the time of a mono-color mode.
FIG. 15 is a diagram showing a prior art color image forming apparatus.
Figure 16:
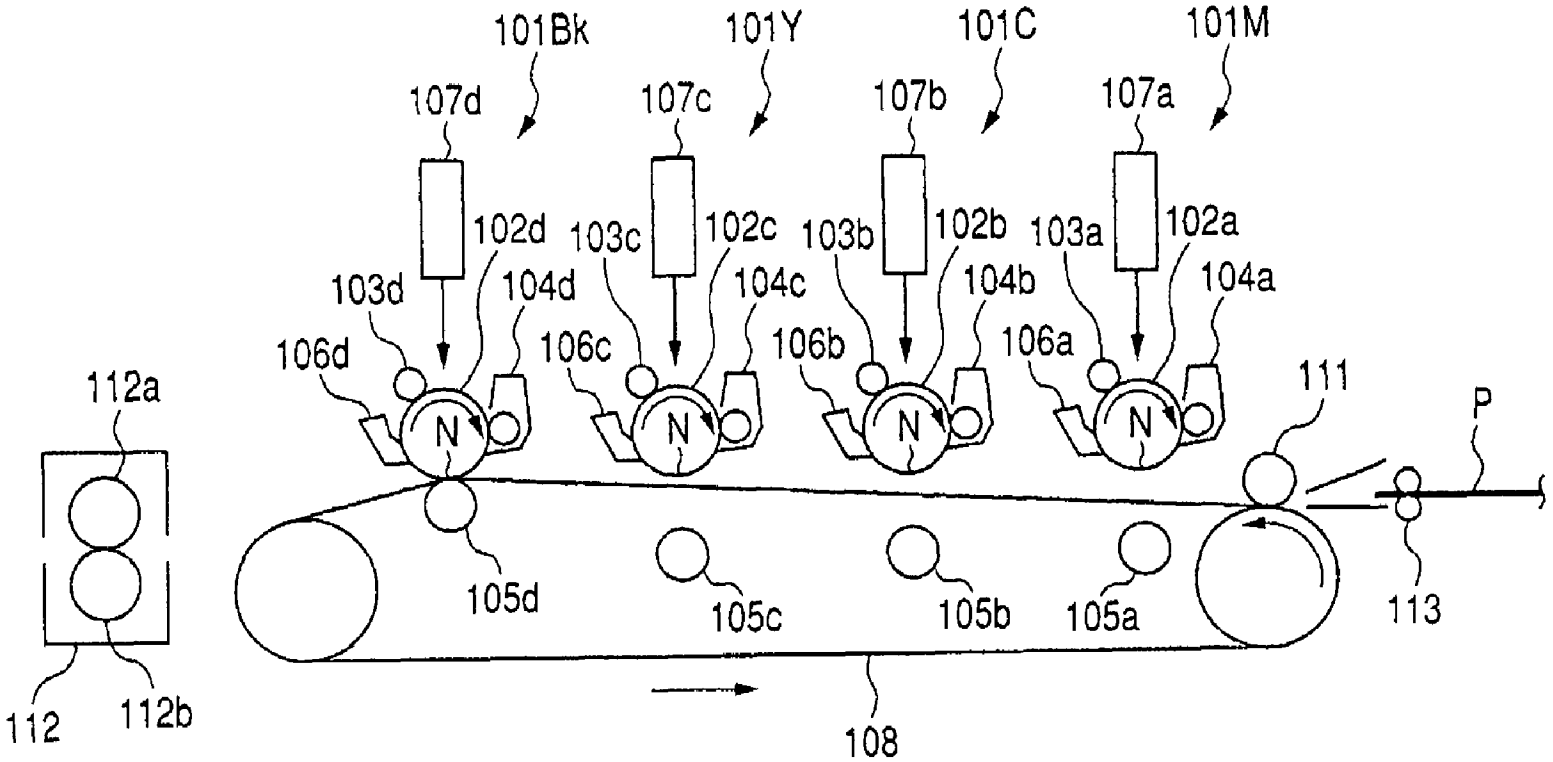
FIG. 16 is a diagram showing a state of setting an intermediate transferring belt apart at the time of a mono-color mode.

FIG. 14 shows the interval for carrying out tiny driving under respective atmospheres.

The reason why frequency of carrying out tiny driving is lower than in Embodiment 1 is that chances of sliding on the photosensitive drums 2*a*, 2*b* and 2*c* are less compared with an image forming apparatus of causing a portion opposite to the photosensitive drums to convey recording material. However, nevertheless, in case of implementing mono-color printing continuously, a memory mark is generated due to sliding of the belt and therefore application of the present invention can prevent occurrence of image defects.

Effects in case of using the present emboidment are likewise those of Embodiment 1 in principle, deriving equivalent effect.

As described above, also in the case where the image forming apparatus is of an intermediate transferring member system, the present embodiment is designed to count the number of printing sheets of mono-color at the time of mono-color (black) image forming (second mode) to carry out tiny rotation in every predetermined number of sheets, and thereby, image defects due to sliding on the photosensitive drums can be prevented from occurring at the time of subsequent full-color printing without sacrificing consumption of image forming parts of color toner also in the case where mono-color printing continued so that images with higher image quality can be derived.

EMBODIMENT 4

The present embodiment is designed to apply a voltage to a charging roller of an image forming parts of color toner at the time of counting the number of printing sheets of mono-color at the time of mono-color (black) image forming (second mode) when to carry out tiny rotating in every predetermined number of sheets. Thereby, the present embodiment cancels current flowing into the photosensitive drums when recording material (or recording material conveying belt) slides on the photosensitive drums in the case of mono-color print to prevent occurrence of memory may so that images with higher image quality can be derived. A method thereof will be described below.

In the present embodiment configuration of an image forming apparatus is schematically the same as that of Embodiment 1, and different parts will be described.

The present embodiment is designed to apply a voltage to a charging roller of an image forming parts of color toner at the time of counting the number of printing sheets of mono-color at the time of mono-color (black) image forming (second mode) when to carry out tiny rotation in every predetermined number of sheets also in the case where the image forming apparatus is of an intermediate transferring member system. Thereby, the present embodiment can cancel changes in potential of the photosensitive drums with current flowing into the photosensitive drums when intermediate transferring belt slides on the photosensitive drums in the case of mono-color print to prevent occurrence of memory mark so that images with higher image quality can be derived. A method thereof will be described below.

In the present embodiment configuration of an image forming apparatus is schematically the same as that of Embodiment 3. In addition, controlling is likewise that of Embodiment 2.

At the time when memory marks (thick color portions) are generated due to current that flows in at the time when the photosensitive drums 2*a*, 2*b* and 2*c* and the intermediate transferring belt 40 have been brought into sliding, it is known to derive approximate balance of −10 V when potential on the surfaces of photosensitive drums of the memory mark corresponding portion is subtracted by average potential on the surfaces of photosensitive drums 2*a*, 2*b* and 2*c* after the charging rollers 3*a*, 3*b* and 3*c* that have applied a voltage have passed by. This is caused by voltage with a positive polarity having been applied to the ICL roller 45 is transmitted through the intermediate transferring belt to end in making charges with positive polarity flow through the photosensitive drums, thus lowering the potential of the photosensitive drums. In particular, in case of an atmosphere with higher temperature and higher moisture (n the case where waving and a core set mark are apt to take place) and in such a case where an intermediate transferring belt with lower resistance, the memory marks are remarkably apt to occur.

The present embodiment implements controlling likewise Embodiment 2 regarding charging rollers 3*a*, 3*b* and 3*c*. Thereby, the present embodiment is likewise Embodiment 2 in principle, deriving equivalent effect.

As described above, the present embodiment is designed to apply a voltage to a charging roller of an image forming parts of color toner at the time of counting the number of printing sheets of mono-color at the time of mono-color (black) image forming (second mode) when to carry out tiny rotation in every predetermined number of sheets. Thereby, the present embodiment can cancel changes in potential of the photosensitive drums with current flowing into the photosensitive drums when intermediate transferring belt slides on the photosensitive drums in the case of mono-color print to prevent occurrence of memory mark so that images with higher image quality can be derived.

Here, in the above described embodiments, a predetermined interval at the time of carrying out tiny rotation was a sheet count of recording material but the predetermined interval may be time.

In addition, in the above described embodiments, three photosensitive drums 2*a*, 2*b* and 2*c* underwent tiny rotation, only one photosensitive drum that will possibly slide on the recording material or the belt, or two photosensitive drums will do.

So far, embodiments of the present invention have been described, but the present invention will not be limited to the above described embodiments any how and all variations falling within the scope of technical thoughts of the present invention can be made.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2005-222598 filed Aug. 1, 2005, and 2006-200872 filed Jul. 24, 2006, which are hereby incorporated by reference herein in their entirety.

What is claimed is:

1. An image forming apparatus comprising:

a first image bearing member which is rotatable and bears an image;

a second image bearing member which is rotatable and bears an image; and a transferring device for transferring images respectively born by said first image bearing member and said second image bearing member onto a recording material;

wherein said first image bearing member and second image bearing member come in contact with said transferring device and an image is respectively formed on said first image bearing member and second image bearing member in a first mode, wherein said first image bearing member is away from said transferring device and second image bearing member comes in contact with said transferring device and an image is formed on said second image bearing member in a second mode, and wherein at said second mode, said first image bearing member starts rotating from a rotation stopped state and afterward stops rotating.

2. An image forming apparatus according to claim 1, wherein, at said second mode, a rotation amount of said first image bearing member for once is less than one rotation.

3. An image forming apparatus according to claim 1, wherein, at said second mode, a rotation of said first image bearing member is carried out every predetermined interval.

4. An image forming apparatus according to claim 3, wherein the predetermined interval is a predetermined number of sheets of recording material.

5. An image forming apparatus according claim 3, wherein the predetermined interval is predetermined time.

6. An image forming apparatus according to claim 3, wherein the predetermined interval is changed depending on type of recording material.

7. An image forming apparatus according to claim 3, wherein the predetermined interval is changed depending on atmospheric conditions.

8. An image forming apparatus according to claim 1, wherein, at said second mode, a rotation of said first image bearing member is carried out in a first direction and in a second direction opposite to said first direction.

9. An image forming apparatus according to claim 8, comprising a cleaning device of cleaning said first image bearing member and a charging device of charging said first image bearing member, wherein, taking L as distance between said cleaning device and said charging device in the rotating direction of said first image bearing member; P1 as movement distance due to rotation in said first direction of said first image bearing member; N1 as movement distance due to rotation in said second direction of said first image bearing member; and P2 as movement distance due to rotation in said first direction of said first image bearing member different from said movement distance P1, the following equations are established here, n is a natural number, $$n \times P1 < L$$

$$n \times P1 < N1$$

$$n \times P1 - N1 + P2 > L.$$

10. An image forming apparatus according to claim 1, comprising a charging device of charging said first image bearing member;

wherein, at said second mode, said charging device does not charge said first image bearing member when said first image bearing member is not rotating but charges said first image bearing member when said firs image bearing member is rotating.

11. An image forming apparatus according to claim 10, wherein timing when said charging device charges said first image bearing member at said second mode is timing when an opposite portion to said transferring device of said first image bearing member reaches said charging device.

12. An image forming apparatus according to claim 10, wherein polarity of voltage applied to said charging device at said second mode is the same as polarity of voltage applied to said charging device at the time of image forming.

13. An image forming apparatus according to claim 1, wherein said transferring device is a recording material conveying belt for bearing recording material to convey.

14. An image forming apparatus according to claim 13, comprising an electrostatic adherence device for bringing a recording material into electrostatic adherence on said transferring device.

15. An image forming apparatus according to claim 14, wherein polarity of voltage applied to said electrostatic adherence device is opposite to polarity of charging of said first image bearing member.

16. An image forming apparatus according to claim 13, wherein said transferring device conveys a recording material from downward to upward.

17. An image forming apparatus according to claim 1, wherein said transferring device is an intermediate transferring belt for bearing images temporarily prior to transferring images on said first image baring member and said second image bearing member onto recording material.

18. An image forming apparatus according to claim 17, comprising a cleaning device for charging toner in order to clean toner on said transferring device.

19. An image forming apparatus according to claim 18, wherein polarity of voltage applied to said cleaning device is opposite to polarity of charging of said first image bearing member.

20. An image forming apparatus according to claim 1, wherein a black toner image is formed on said second image bearing member.

21. An image forming apparatus according to claim 1, wherein a plurality of said first image bearing member are present so that magenta, cyan, yellow toner images are formed respectively on the plurality of said first image bearing member.

* * * * *

UNITED STATES PATENT AND TRADEMARK OFFICE

CERTIFICATE OF CORRECTION

PATENT NO. : 7,424,254 B2
APPLICATION NO. : 11/494564
DATED : September 9, 2008
INVENTOR(S) : Tomoo Akizuki et al.

It is certified that error appears in the above-identified patent and that said Letters Patent is hereby corrected as shown below:

ON THE COVER PAGE:

At Item (57), Abstract, line 5, "born" should read --borne--.

COLUMN 1:

Line 14, "has been" should read --are--.
Line 48, "above described" should read --above-described--.
Line 52, "born" should read --borne--.
Line 54, "with" should read --by means of--.
Line 56, "adherence roller 111 is adhered" should read --adherence roller 111, the recording material is electrostatically adhered--.
Line 57, "conveying belt 108 electrostatically and is born" should read --conveying belt 108, whereby the recording material is borne--.
Line 58, "with" should read --by--.

COLUMN 2:

Line 2, "above described" should read --above-described--.
Line 12, "above described" should read --above-described--.
Line 19, "above described" should read --above-described--.

COLUMN 3:

Line 7, "follow." should read --follows.--.

COLUMN 4:

Line 20, "above described" should read --above-described--.
Line 30, "An" should read --an--.
Line 35, "born" should read --borne--.
Line 46, "rotation stopped" should read --rotation-stopped--.

COLUMN 6:

Line 48, "born" should read --borne--.

COLUMN 7:

Line 41, "born" should read --borne--.
Line 51, "above described" should read --above-described--.

COLUMN 8:

Line 48, "born" should read --borne--.

UNITED STATES PATENT AND TRADEMARK OFFICE

CERTIFICATE OF CORRECTION

PATENT NO. : 7,424,254 B2
APPLICATION NO. : 11/494564
DATED : September 9, 2008
INVENTOR(S) : Tomoo Akizuki et al.

It is certified that error appears in the above-identified patent and that said Letters Patent is hereby corrected as shown below:

COLUMN 9:
Line 17, “above” should read --above- --.
Line 25, “above described” should read --above-described--.
Line 60, “above described” should read --above-described--.

COLUMN 12:
Line 57, “and (L)” should read --and (L) are--.

COLUMN 13
Line 2, “above” should read --above- --.
Line 7, “exposure” should read --expose--.

COLUMN 14:
Line 38, “above described” should read --above-described--.

COLUMN 16:
Line 22, “midst” should read --the midst--.
Line 39, “above described” should read --above-described--.
Line 60, “preferable” should read --preferably--.

COLUMN 18:
Line 33, “above” should read --above- --.
Line 64, “above described” should read --above-described--.

COLUMN 19:
Line 9 and 10, “a power supply for cleaning not shown in the drawings.” should read --a power supply (not shown) for cleaning.--.
Line 24, “above described” should read --above-described--.
Line 59, “above described” should read --above-described--.

COLUMN 20:
Line 33, “may” should read --mark--.

UNITED STATES PATENT AND TRADEMARK OFFICE

CERTIFICATE OF CORRECTION

PATENT NO. : 7,424,254 B2
APPLICATION NO. : 11/494564
DATED : September 9, 2008
INVENTOR(S) : Tomoo Akizuki et al.

It is certified that error appears in the above-identified patent and that said Letters Patent is hereby corrected as shown below:

COLUMN 21:

Line 25, "above described" should read --above-described--.

Line 26, "at" should read --for--; "tiny" should read --a small amount of--; and after "was" insert --based on--.

Line 28, after "may be" insert --a measurement of--.

Line 29, "above described" should read --above-described--.

Line 36, "above described" should read --above-described--; and "any how" should read --anyhow--.

COLUMN 22:

Line 6, "for once" should be deleted.

Line 16, "is predetermined" should read --is a predetermined--.

Line 29, "of" should read --for--.

COLUMN 24:

Line 1, "baring" should read --bearing--.

Line 15, "member" should read --members--.

Line 16, "yellow" should read --and yellow--.

Line 18, "member." should read --members.--.

Signed and Sealed this

Eighth Day of September, 2009

David J. Kappos

David J. Kappos
*Director of the United States Patent and Trademark Office*